US011725899B2

(12) United States Patent
Trpkovski et al.

(10) Patent No.: US 11,725,899 B2
(45) Date of Patent: Aug. 15, 2023

(54) COMPACT PROJECTILE LAUNCHER

(71) Applicant: Ravin Crossbows, LLC, Superior, WI (US)

(72) Inventors: Paul Trpkovski, Kailua Kona, HI (US); Joshua Hanzel, Kailua Kona, HI (US)

(73) Assignee: RAVIN CROSSBOWS, LLC, Superior, WI (US)

( * ) Notice: Subject to any disclaimer, the term of this patent is extended or adjusted under 35 U.S.C. 154(b) by 16 days.

(21) Appl. No.: 17/571,290

(22) Filed: Jan. 7, 2022

(65) Prior Publication Data

US 2022/0214131 A1 Jul. 7, 2022

Related U.S. Application Data

(60) Provisional application No. 63/136,451, filed on Jan. 12, 2021, provisional application No. 63/134,953, filed on Jan. 7, 2021.

(51) Int. Cl.
*F41B 5/12* (2006.01)

(52) U.S. Cl.
CPC ..... *F41B 5/123* (2013.01)

(58) Field of Classification Search
CPC .. F41B 5/00; F41B 5/0094; F41B 5/12; F41B 5/123; F41B 5/1469
See application file for complete search history.

(56) References Cited

U.S. PATENT DOCUMENTS

| | | | | |
|---|---|---|---|---|
| 2,714,884 | A * | 8/1955 | Ickes | F41B 5/12 124/35.1 |
| 4,903,677 | A | 2/1990 | Colley et al. | |
| 4,911,136 | A * | 3/1990 | Brown | F41B 3/02 124/16 |
| 8,485,170 | B1 * | 7/2013 | Prior | F41B 5/0094 124/25 |
| 8,863,732 | B1 * | 10/2014 | Prior | F41B 5/123 124/25 |
| 9,146,071 | B2 | 9/2015 | Liu | |
| 9,719,749 | B1 * | 8/2017 | Prior | F41B 3/005 |
| 10,962,323 | B2 | 3/2021 | Langley | |
| 11,512,921 | B1 * | 11/2022 | Xiao | F41B 5/0094 |
| 2018/0321011 | A1 | 11/2018 | Yehle | |

(Continued)

FOREIGN PATENT DOCUMENTS

KR 20100039306 A 4/2010

OTHER PUBLICATIONS

O'Neal, Bridget; 3DR Holdings; New 3D Printed Viney Compound Bow Prototype Hits the Mark for Fun; 5 pages; Nov. 19, 2014.

(Continued)

*Primary Examiner* — John A Ricci
(74) *Attorney, Agent, or Firm* — Foley & Lardner LLP

(57) ABSTRACT

A projectile launcher includes a frame that has a front and rear end. A projectile is configured to be propelled from the front end of the frame and the projectile is movable along a projectile axis during firing and arming of the projectile launcher. The projectile launcher includes a latch movable between the rear end of the frame and the front end of the frame along a travel axis and is attached to a crank mechanism via a tether. The projectile launcher also includes flexible limbs that drive a drawstring of the projectile launcher during the firing of the projectile launcher.

20 Claims, 38 Drawing Sheets

(56) References Cited

U.S. PATENT DOCUMENTS

| | | | |
|---|---|---|---|
| 2020/0355458 | A1 | 11/2020 | Langley |
| 2020/0370856 | A1 | 11/2020 | Trpkovski |
| 2021/0048268 | A1 | 2/2021 | Trpkovski |
| 2021/0080218 | A1 | 3/2021 | Trpkovski |

OTHER PUBLICATIONS

International Search Report and Written Opinion issued in International Patent Application No. PCT/US2022/011699, dated Sep. 19, 2022.

* cited by examiner

COMPACT PROJECTILE LAUNCHER

CROSS-REFERENCE TO RELATED APPLICATIONS

This application claims priority to U.S. Application No. 63/136,451, filed on Jan. 12, 2021, titled COMPACT PROJECTILE LAUNCHER, and to U.S. 63/134,953, filed on Jan. 7, 2021, titled COMPACT PROJECTILE LAUNCHER, the disclosures of which are hereby incorporated by reference in their entireties.

BACKGROUND

Projectile launchers, such as crossbows and slingshots, utilize a string that is drawn backward and released to fire a projectile. Flexible limbs are loaded with force by the drawstring being drawn, and limbs are unloaded with force when the crossbow is fired to aggressively power the movement of the drawstring toward the front of the crossbow.

To increase the firing speed of a projectile launcher, the power stroke, which is the distance the drawstring travels from the drawn position to a position when it releases the arrow, must be increased and/or the size (and therefore the power) of the limbs must be increased. This increases the size of the crossbow, thereby rendering the crossbow cumbersome to handle, fire, and transport. However, a crossbow must be able to fire projectiles at adequate speeds for a variety of different applications, such as hunting, bow fishing, long-range target shooting, etc. Therefore, improvements are desired.

SUMMARY

This application generally relates to a compact projectile launcher. Specifically, the disclosure relates to a compact crossbow that includes a movable, compact windable latch mechanism, a drawstring, a pair of power strings, a string hub, and an interface for a modular stock.

In one aspect of the present disclosure, a projectile launcher is disclosed. The projectile launcher includes a frame having a vertical grip and the frame defines a horizontal projectile plane at a top side in which a projectile axis is positioned. A projectile moves within the horizontal projectile plane and along the projectile axis during firing and arming of the projectile launcher. The projectile is fired from a front end of the frame. The projectile launcher includes a string hub rotatably mounted to the frame. The string hub is rotatable about a central axis in a first direction and a second direction and the central axis is perpendicular to the projectile axis. The projectile launcher includes a drawstring that is attached to the string hub. The drawstring travels at least partially perpendicular to the projectile axis between first and the second ends of the drawstring. The drawstring is movable within the projectile plane during firing and arming of the projectile launcher. Movement of the drawstring away from the string hub corresponds with rotation of the string hub in the first direction, and movement of the drawstring toward the string hub corresponds with rotation of the string hub in the second direction. The projectile launcher includes a first and a second flexible limb attached to the frame. The first and second limbs are in an unloaded position when the projectile launcher is undrawn and in a loaded position when the projectile launcher is drawn. The projectile launcher includes a first and a second power cable each having a first end and a second end. The first ends of the first and second power cables are attached to the string hub at power cable sections. Upon rotation of the string hub in the first direction, the first and second power cables are configured to draw the first and second flexible limbs closer to the string hub. The projectile launcher includes a latch movable between the rear end of the frame and the front end of the frame and attached to a crank mechanism via a tether. The latch is configured to receive the drawstring and hold the drawstring at the rear end of the frame when the crossbow is drawn. The latch is configured to receive a portion of the projectile and the drawstring therein. The tether travels downward from the latch to wrap around a first gear of the crank mechanism. The crank mechanism has a spring loaded stop in communication with the first gear. The stop is biased against the first gear, and the stop is accessible at an underside of the frame. The projectile launcher includes a trigger assembly in communication with the latch. Upon activation of the trigger assembly when firing, the trigger assembly moves the latch and the drawstring is released from the latch. The projectile launcher includes first and second drawstring guides attached to the frame, each guide guiding the drawstring across the projectile axis between the first and second ends of the drawstring.

In another aspect of the present disclosure, a projectile launcher is disclosed. The projectile launcher includes a frame that has a front and rear end. A projectile is configured to be propelled from the front end of the frame and the projectile is movable along a projectile axis during firing and arming of the projectile launcher. The projectile launcher includes a latch movable between the rear end of the frame and the front end of the frame along a travel axis and attached to a crank mechanism via a tether. The latch is configured to receive a portion of the projectile therein. The crank mechanism is configured to pull at least a portion of the tether at least partially in a direction perpendicular to the travel axis.

In another aspect of the present disclosure, a projectile launcher is disclosed. The projectile launcher includes a frame that has a front end and a rear end. The projectile launcher includes a string hub rotatably mounted to the frame. The string hub is rotatable about a central axis in a first direction and a second direction. The central axis is perpendicular to the projectile axis. The string hub has a power cable section and a drawstring section. The power cable section has power cable grooves and the drawstring section has drawstring grooves. The projectile launcher includes a drawstring attached to the string hub at the drawstring section and positionable within the drawstring grooves at the drawstring section. The projectile launcher includes at least one flexible limb attached to the frame. The at least one limb is in an unloaded position when the projectile launcher is undrawn and in a loaded position when the projectile launcher is drawn. The projectile launcher includes at least one power cable attached to the at least one flexible limb and the string hub. The at least one power cable is positionable within the power cable grooves at the power cable section of the string hub. The power cable grooves decrease in circumference as the at least one power cable is wound within the power cable grooves as the projectile launcher is moved from undrawn to drawn.

In another aspect of the present disclosure, a projectile launcher is disclosed. The projectile launcher includes a frame that has a front end and a rear end. The projectile launcher includes a string hub rotatably mounted to the frame. The string hub is rotatable about a central axis in a first direction and a second direction. The central axis is perpendicular to the projectile axis. The string hub has a power cable section and a drawstring section. The power cable section has power cable grooves and the drawstring section has drawstring grooves. The projectile launcher includes a drawstring attached to the string hub at the drawstring section and positionable within the drawstring grooves at the drawstring section. The drawstring travels at least partially perpendicular to the projectile axis between first and the second ends of the drawstring. Movement of the drawstring away from the string hub corresponds with rotation of the string hub in the first direction, and movement of the string toward the string hub corresponds with rotation of the string hub in the second direction. The projectile launcher includes a first and a second flexible limb attached to the frame. The first and second limbs are in an unloaded position when the projectile launcher is undrawn and in a loaded position when the projectile launcher is drawn. The projectile launcher includes a first and a second power cable each being attached to the first and the second flexible limbs and the string hub at the power cable section, respectively. The first and second power cables are positionable within the power cable grooves at the power cable section of the string hub. The power cable grooves decrease in circumference as the first and second power cables are wound within the power cable grooves as the projectile launcher is moved from undrawn to drawn. The projectile launcher includes a latch movable between the rear end of the frame and the front end of the frame along a travel axis and attached to a crank mechanism via a tether. The latch is configured to receive a portion of the projectile therein and the crank mechanism is configured to pull at least a portion of the tether at least partially in a direction perpendicular to the travel axis. The projectile launcher includes a trigger assembly being in communication with the latch. Upon activation of the trigger assembly when firing, the trigger assembly moves the latch and the drawstring is released from the latch.

In another aspect of the present disclosure, a projectile launcher is disclosed. The projectile launcher includes a frame having a vertical grip. The frame defines a horizontal projectile plane at a top side in which a projectile axis is positioned. A projectile moves within the horizontal projectile plane and along the projectile axis during firing and arming of the projectile launcher, and is fired from a front end of the frame. The frame also includes a limb with a distal limb support at first end of the limb and a medial limb support along the length of the limb.

In another aspect of the present disclosure, a projectile launcher is disclosed. The projectile launcher includes a frame having a vertical grip. The frame defines a horizontal projectile plane at a top side in which a projectile axis is positioned. A projectile moves within the horizontal projectile plane and along the projectile axis during firing and arming of the projectile launcher, and is fired from a front end of the frame. The frame has a length between a front and a rear end of the frame in a range from about 15 inches to about 23 inches (or from 15 inches to 23 inches) (38 cm to 58 cm).

In another aspect of the present disclosure, a projectile launcher is disclosed. The projectile launcher includes a frame having a vertical grip. The frame defines a horizontal projectile plane at a top side in which a projectile axis is positioned. A projectile moves within the horizontal projectile plane and along the projectile axis during firing and arming of the projectile launcher, and is fired from a front end of the frame. The projectile launcher also includes a reinforcement arch that extends over and traverses the projectile axis and connects to the frame on either side of the projectile axis.

In another aspect of the present disclosure, a projectile launcher is disclosed. The projectile launcher includes a frame having a vertical grip. The frame defines a horizontal projectile plane at a top side in which a projectile axis is positioned. A projectile moves within the horizontal projectile plane and along the projectile axis during firing and arming of the projectile launcher, and is fired from a front end of the frame. The frame also includes an arrow rest positioned to support a projectile.

In another aspect of the present disclosure, a projectile launcher is disclosed. The projectile launcher includes a frame having a vertical grip. The frame defines a horizontal projectile plane at a top side in which a projectile axis is positioned. A projectile moves within the horizontal projectile plane and along the projectile axis during firing and arming of the projectile launcher, and is fired from a front end of the frame. The projectile launcher also includes a string hub that drives the movement of a drawstring.

In another aspect of the present disclosure, a projectile launcher is disclosed. The projectile launcher includes a frame. The frame defines a horizontal projectile plane at a top side in which a projectile axis is positioned. The frame also defines a vertical projectile plane perpendicular to the horizontal projectile plane in which the projectile axis is positioned. A projectile moves within the horizontal projectile plane and vertical projectile plane along the projectile axis during firing and arming of the projectile launcher. The projectile is fired from a front end of the frame. The projectile launcher also includes a string hub that drives the movement of a drawstring.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A projectile launcher 100 (e.g., a compact crossbow) is disclosed herein. The projectile launcher 100 can be used in different arrangements to improve efficiency, improve balance, improve safety, shoot different projectiles, and improve accuracy. Further, due to its compact nature and its ability to fire projectiles at high speeds, the projectile launcher 100 can be utilized for hunting, such as for bow hunting.

Figure 9:
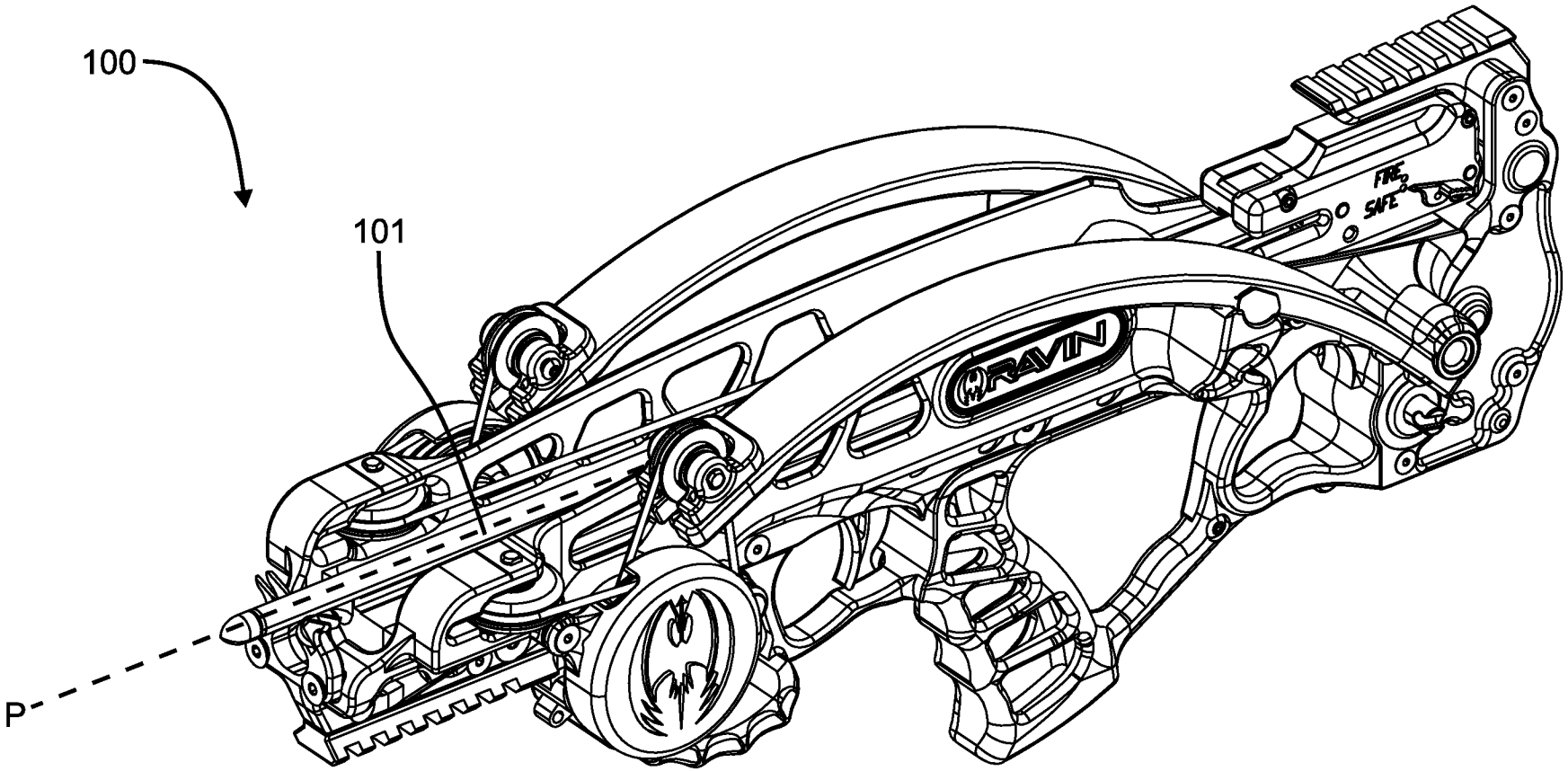
FIG. 9 shows another perspective of the projectile launcher of FIG. 5 in the drawn position.
Figure 10:
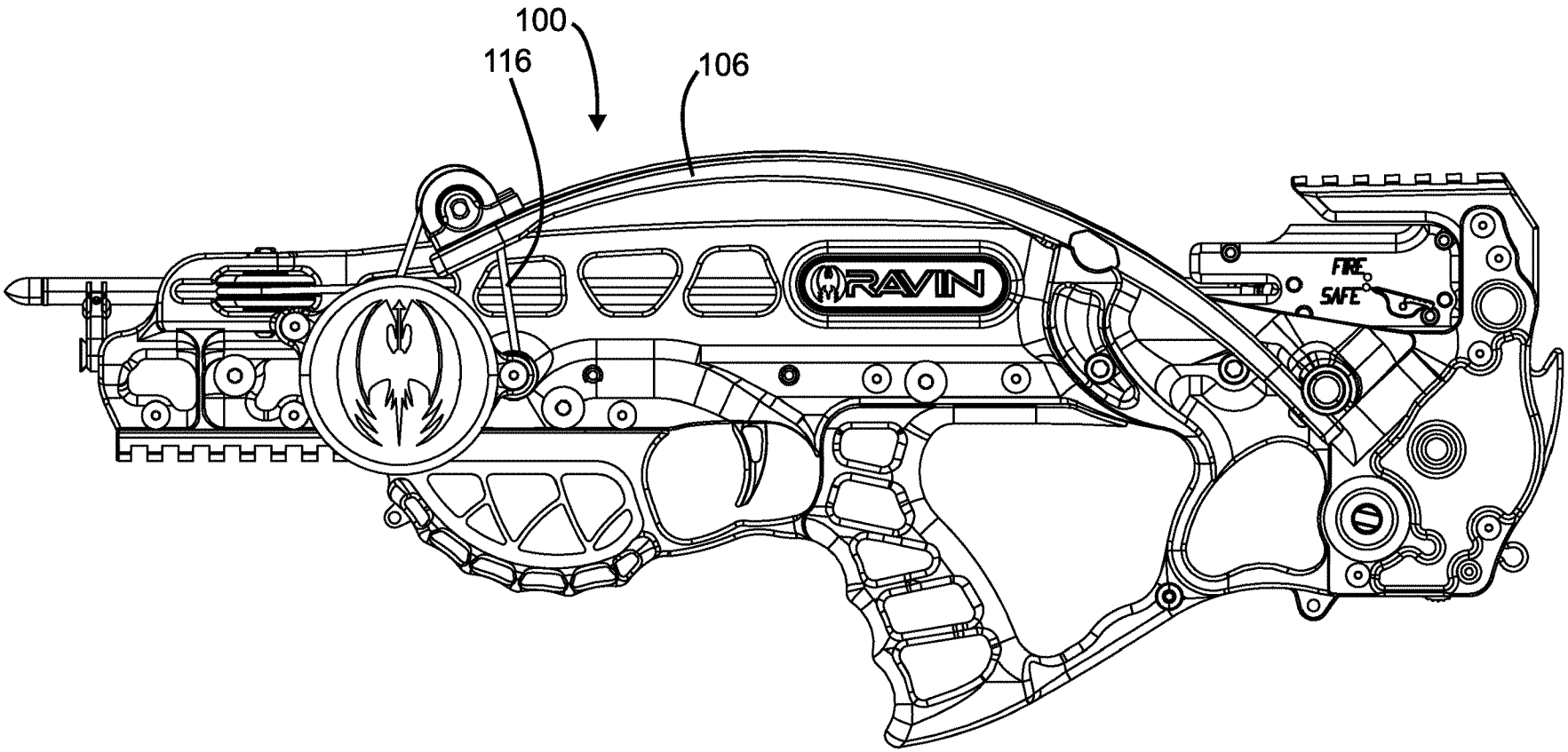
FIG. 10 shows a side view of the projectile launcher of FIG. 5 in the drawn position.
Figure 11:
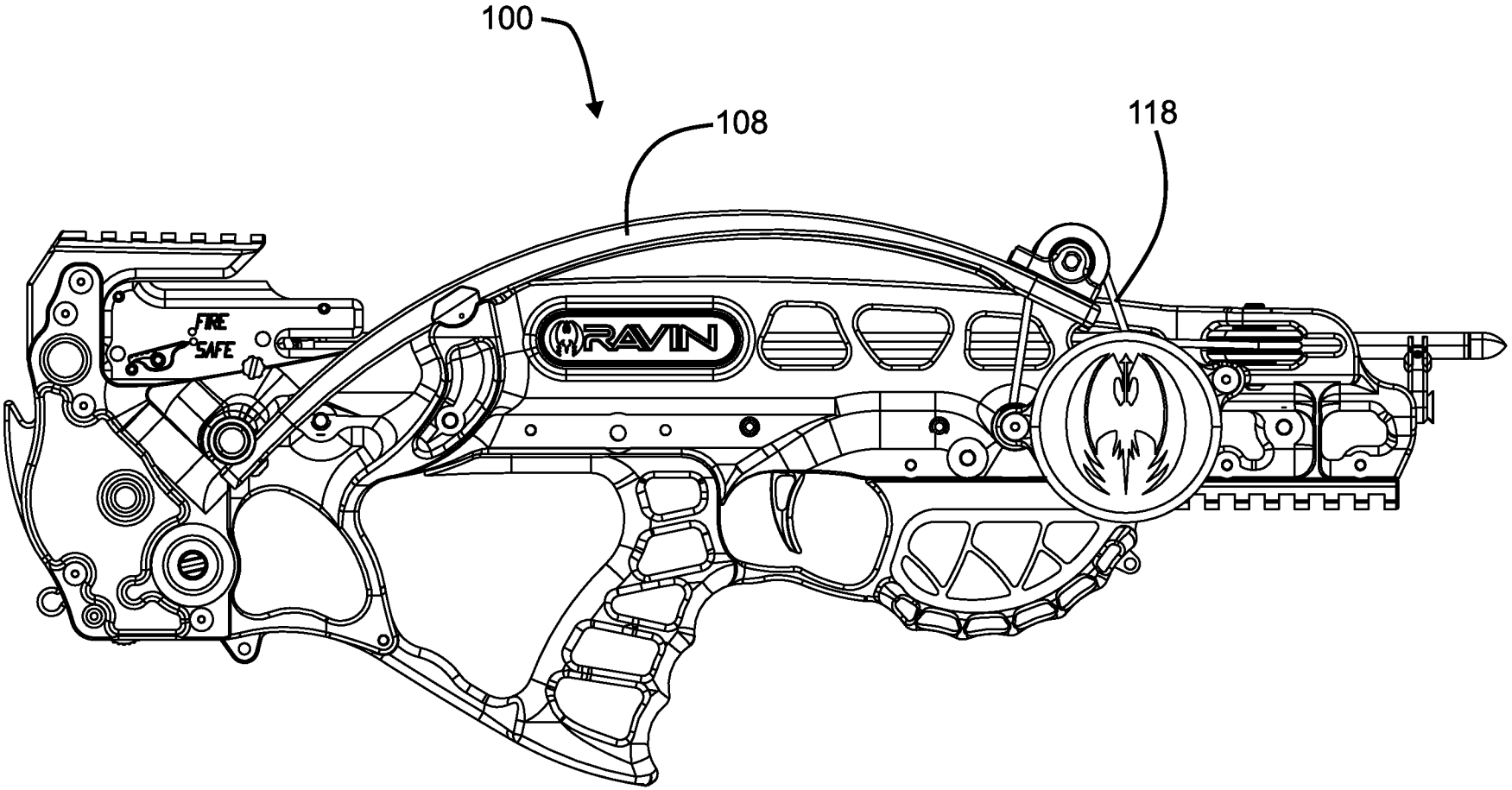
FIG. 11 shows another side view of the projectile launcher of FIG. 5 in the drawn position.

Specifically, the projectile launcher 100 is configured to fire a projectile 101, such as an arrow. The projectile 101 has a projectile axis P that extends longitudinally along the projectile 101 (shown in FIGS. 9 and 12). The projectile launcher 100 includes a frame 102, a drawstring 104, a first limb 106, a second limb 108, a string hub 110, a first drawstring wheel 111, a second drawstring wheel 113, a first power wheel 112, a second power wheel 114, a first power cable 116, a second power cable 118, a first drawstring guide 119, a second drawstring guide 121, a latch 120, a trigger assembly 122, an arrow rest 124, an accessory rail 126, a grip 128, a trigger guard 130, and a gripping cutout 132.

The projectile launcher 100 operates by utilizing the movable latch 120 that travels along and between a front 103 and a rear 105 of the frame 102. The latch 120 travels to the front of the projectile launcher 100 along the frame 102, attaches to the drawstring 104 and a user draws the latch 120 rearward. As the drawstring 104 is drawn rearward, the limbs 106, 108 that are connected thereto are drawn downward and loaded. This is because the drawstring 104 wraps multiple times around the drawstring wheels 111, 113 and the movement of the drawstring 104 moves the drawstring wheels 111, 113. The drawstring wheels 111, 113 are fixed to string hub 110 and the power wheels 112, 114 are also fixed to the string hub 110 and rotate therewith. The power cables 116, 118 are each connected to the limbs 106, 108 and the power wheels 112, 114, respectively. As the drawstring 104 is moved rearward, the drawstring 104 rotates the drawstring wheels 111, 113, which rotate the string hub 110, which rotates the power wheels 112, 114, which wind the power cables 116, 118 around the power wheels 112, 114, which load (e.g., force downward) the limbs 106, 108. Once fully rearward, the latch 120 is secured and a projectile 101 (i.e., an arrow) can be loaded. The latch 120 is in communication with the trigger assembly 122 and the user can move a trigger pull 123 of the trigger assembly 122 to release the drawstring 104 from the latch 120, thereby propelling the projectile 101 forward from the projectile launcher 100.

Figure 1:
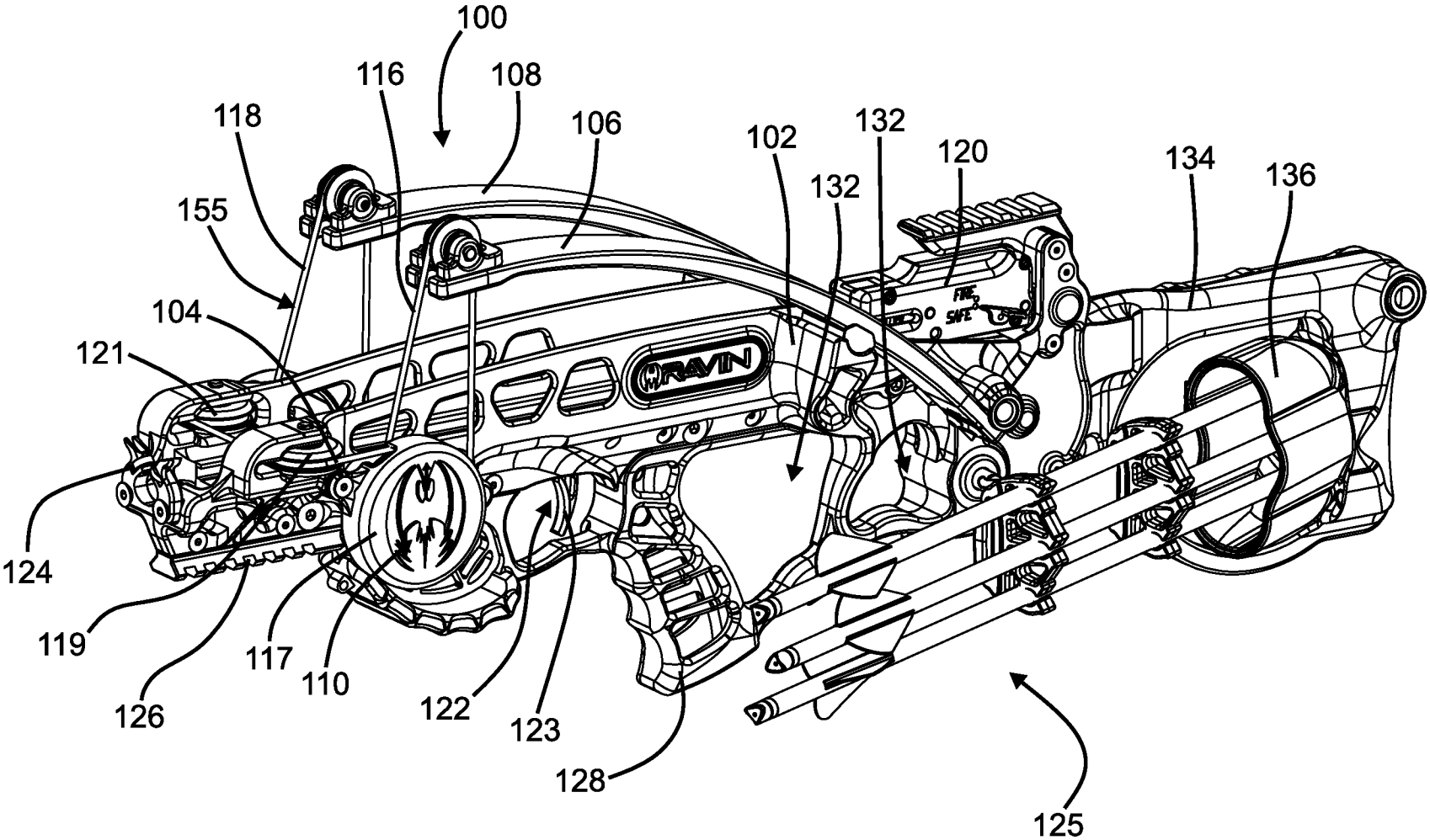
FIG. 1 shows a perspective view of a weapon system, according to one example of the present disclosure.
Figure 2:
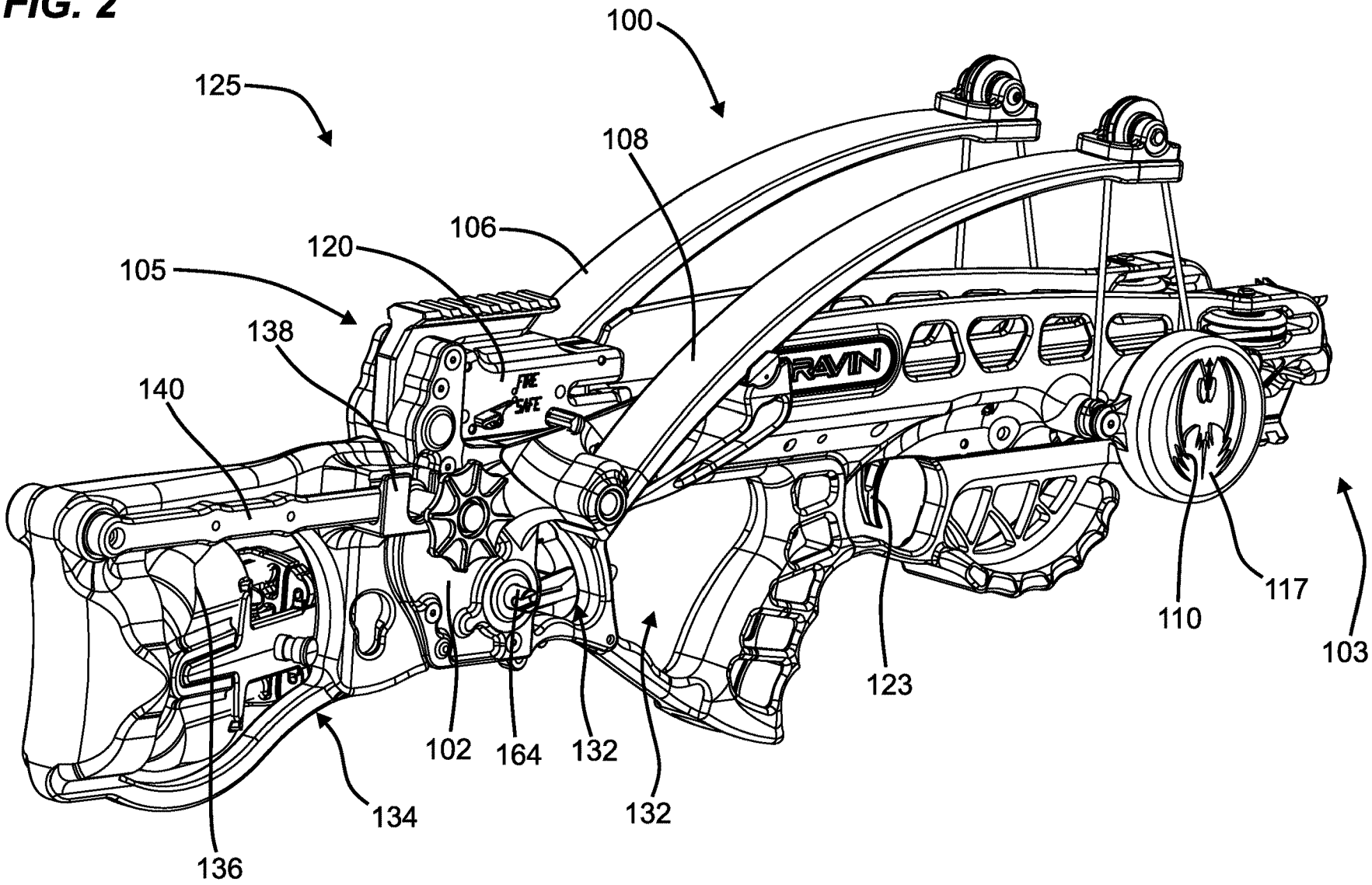
FIG. 2 shows another perspective view of the weapon system of FIG. 1.

FIGS. 1 and 2 show perspective views of the weapon system 125 that includes a projectile launcher 100 and a stock 134 attached the frame 102 of the projectile launcher 100. The stock 134 is shown including a quiver 136 removably attached thereto, and a storage area 138 for an arming tool 140.

The frame 102 can be constructed of a composite, wood, metal, or like material. In some examples, the frame 102 is a singular unibody component. In other examples, the frame 102 has a multiple-piece construction. In such an examples, the frame 102 can include multiple portions that mate together along a longitudinal axis of the frame 102. In such an example, the trigger assembly 122 can be positioned between the multiple portions of the frame 102. In some examples, the frame 102 is configured to include a variety of different mounting points for various module accessories such as flashlights, sighting accessories, or other attachments. The frame 102 defines a horizontal projectile plane at a top side 155 in which a projectile axis P is positioned. The projectile moves within the horizontal projectile plane and along the projectile axis P during firing and arming of the projectile launcher.

The drawstring 104 can be constructed of traditional bowstring material such as, but not limited to, composite and/or natural fibers.

The limbs 106 and 108 power the rotation of the string hub 110. In some examples, the limbs 106, 108 are elastic and spring-like in nature. In some examples, a single limb can be utilized. In some examples, the limbs 106, 108 extend in an upward direction from a top side of the frame 102 and in a forward direction toward the front end 103 of the frame 102. It is considered within the scope of the present disclosure that the limbs 106, 108 may be positioned in a variety of different ways relative to the frame 102.

The power cables 116, 118 can be attached to and/or wound around the first and second limbs 106, 108. In some examples, the power cables 116, 118 can be constructed of a variety of different materials such as, but not limited to, composite and/or natural fibers, metal, plastic, etc.

Figure 3:
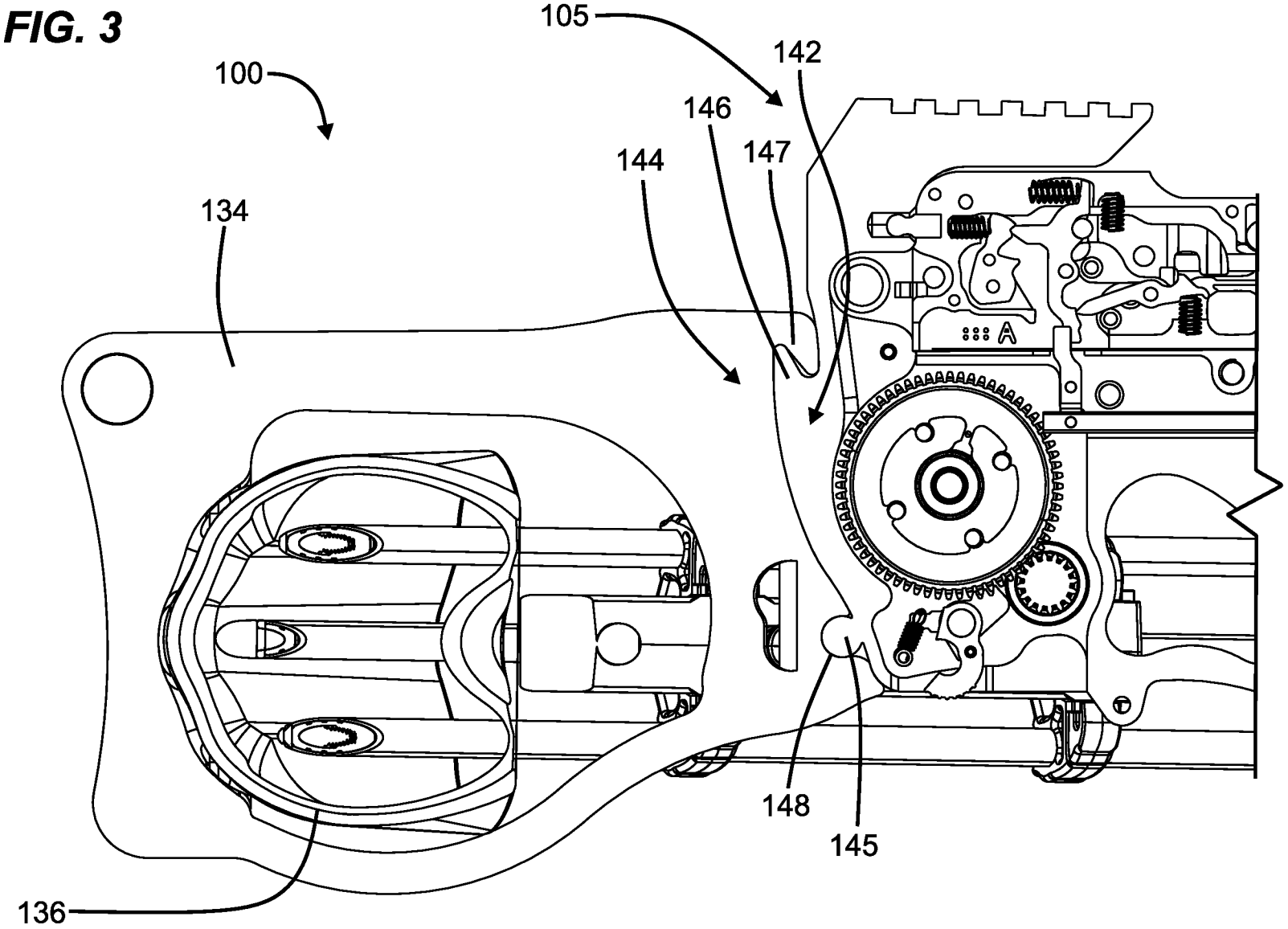
FIG. 3 shows a longitudinal cross-section of a portion of the weapon system of FIG. 1.
Figure 14:
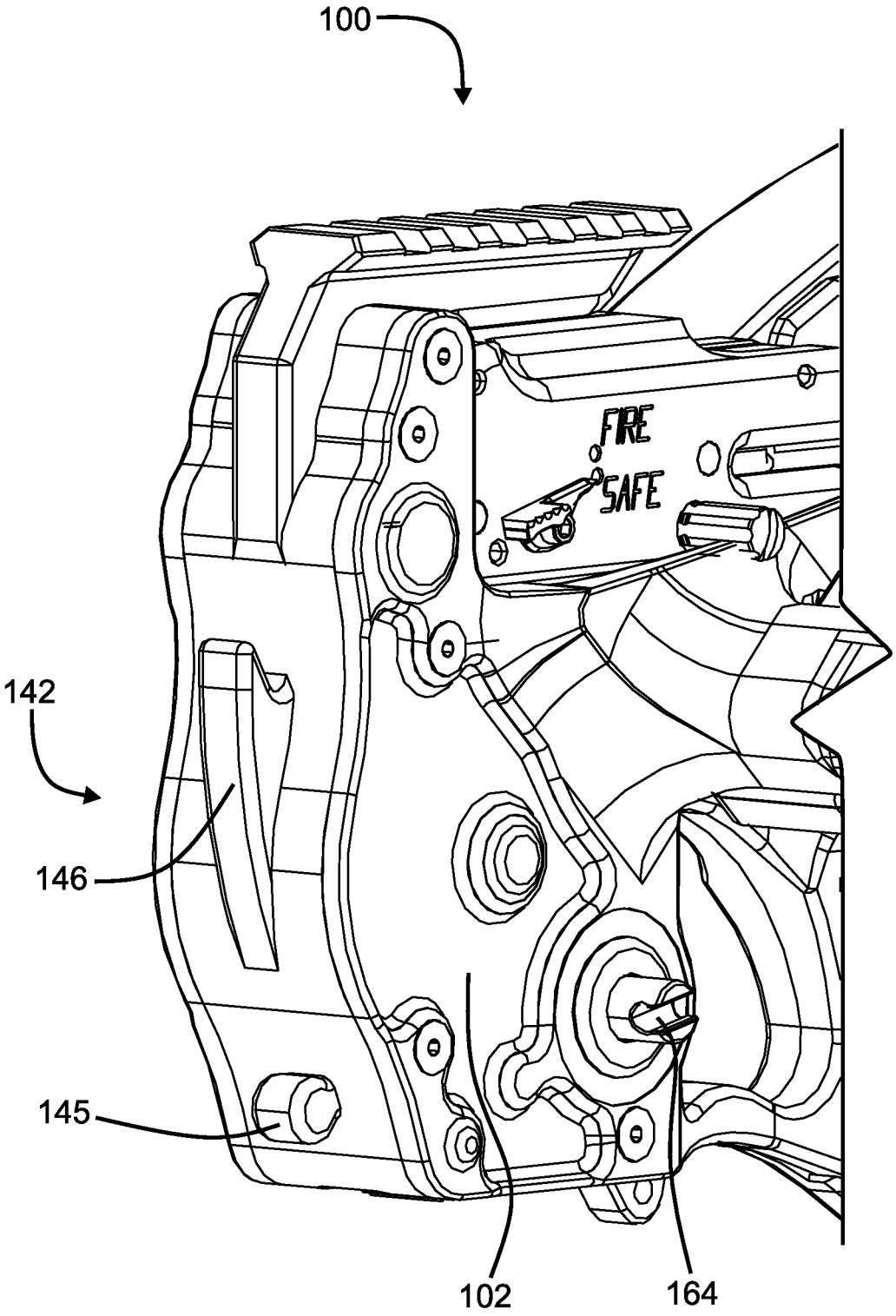
FIG. 14 shows a rear perspective view of the projectile launcher of FIG. 5.
Figure 15:
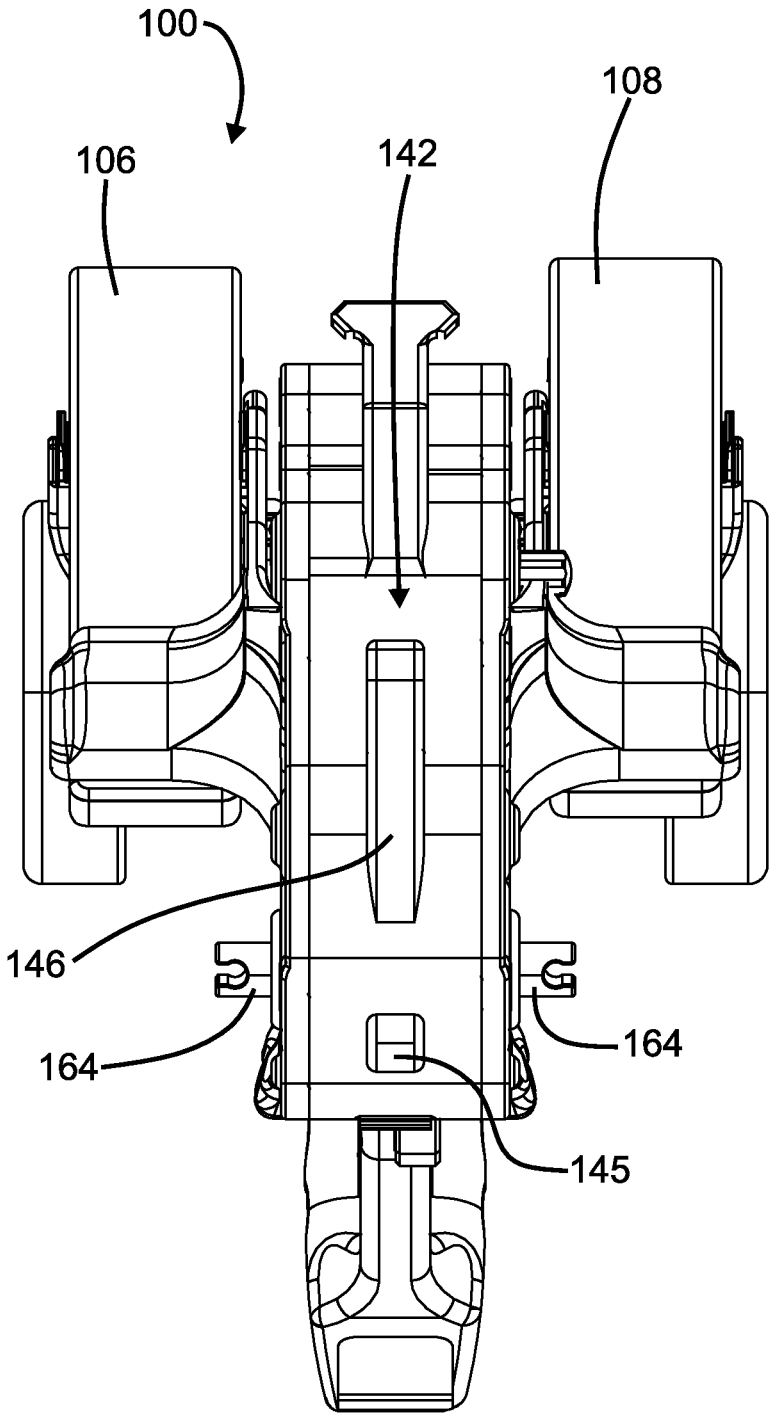
FIG. 15 shows a rear view of the projectile launcher of FIG. 5 in the drawn position.

As shown in FIG. 3, the projectile launcher 100 includes a rear interface 142 that mates with a stock interface 144 of the stock 134. The rear interface 142 includes an upward facing hook 146 and a post 145. The stock interface 144 includes a hook recess 147 that mates with the hook 146 and a post recess 148 that mates with the post 145, as shown in a closer view in FIGS. 14 and 15. In some examples, the mating between the stock interface 144 and the rear interface 142 utilizes an interference fit. In some examples, an interference fit is used between the post 145 and the post recess 148. In some examples, the stock 134 can be removed from the frame 102 without the use of tools. It is considered within the scope of the present disclosure that a variety of different tool-less connections can be used between the stock 134 and the frame 102.

Figure 4:
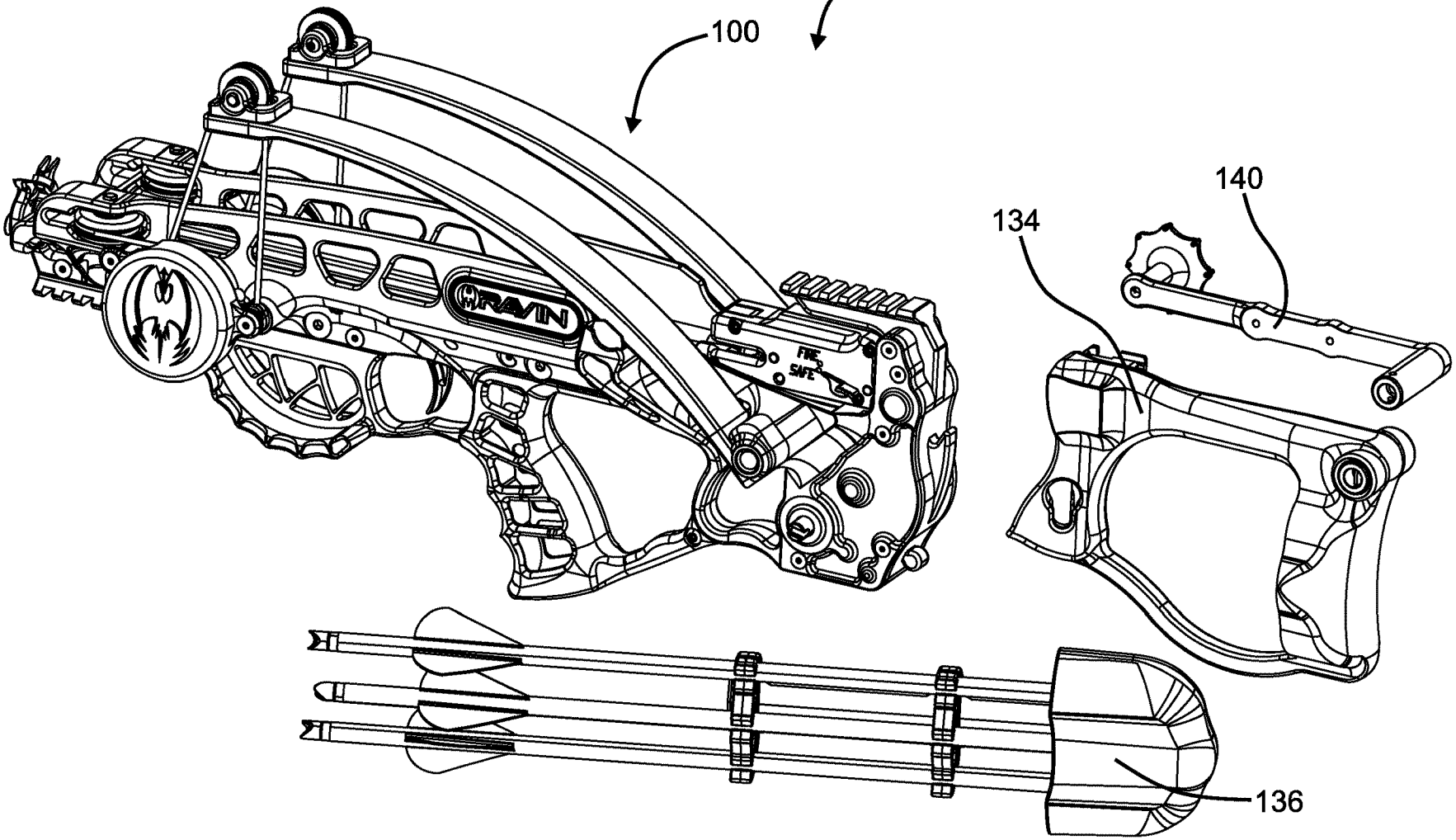
FIG. 4 shows an exploded view of the weapon system of FIG. 1.

FIG. 4 shows the stock 134, quiver 136, and arming tool 140 separated from the frame 102 of the projectile launcher 100.

FIGS. 5-8 show the projectile launcher 100 in the undrawn position. FIGS. 9-15 show the projectile launcher 100 in the drawn position with the projectile 101 loaded therein.

Figure 12:
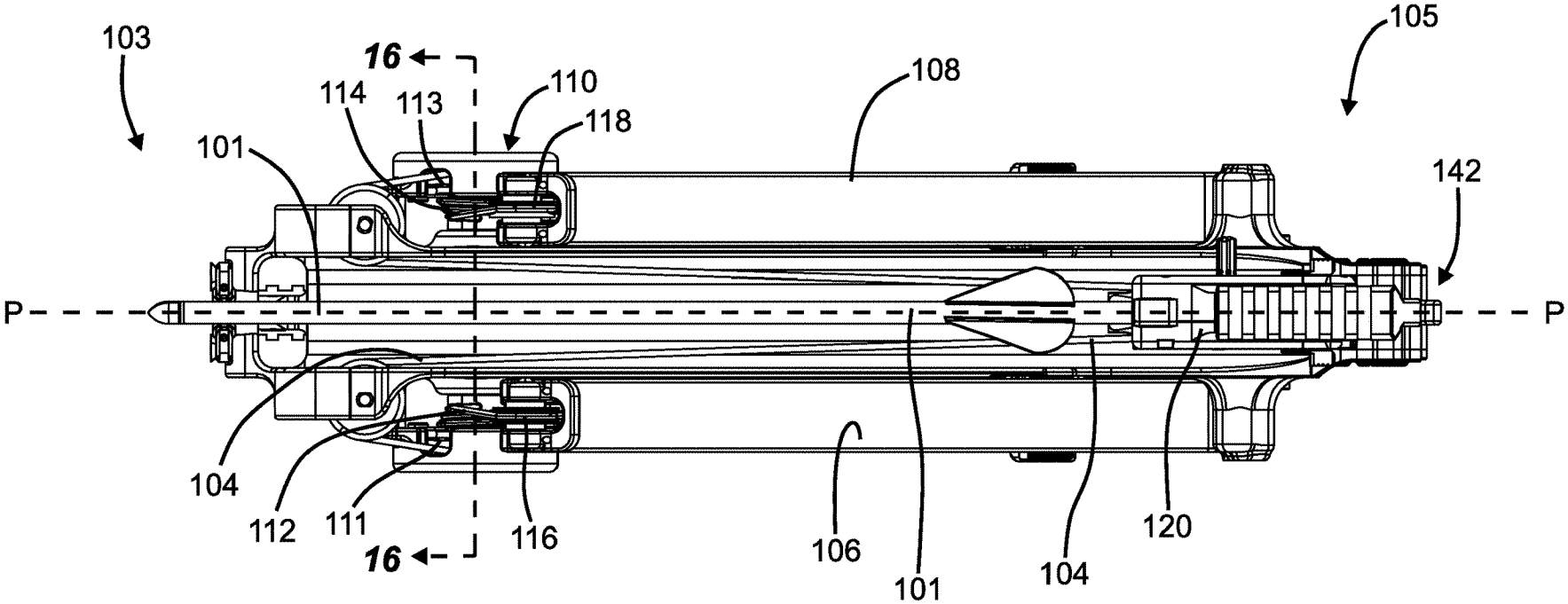
FIG. 12 shows a top view of the projectile launcher of FIG. 5 in the drawn position.
Figure 13:
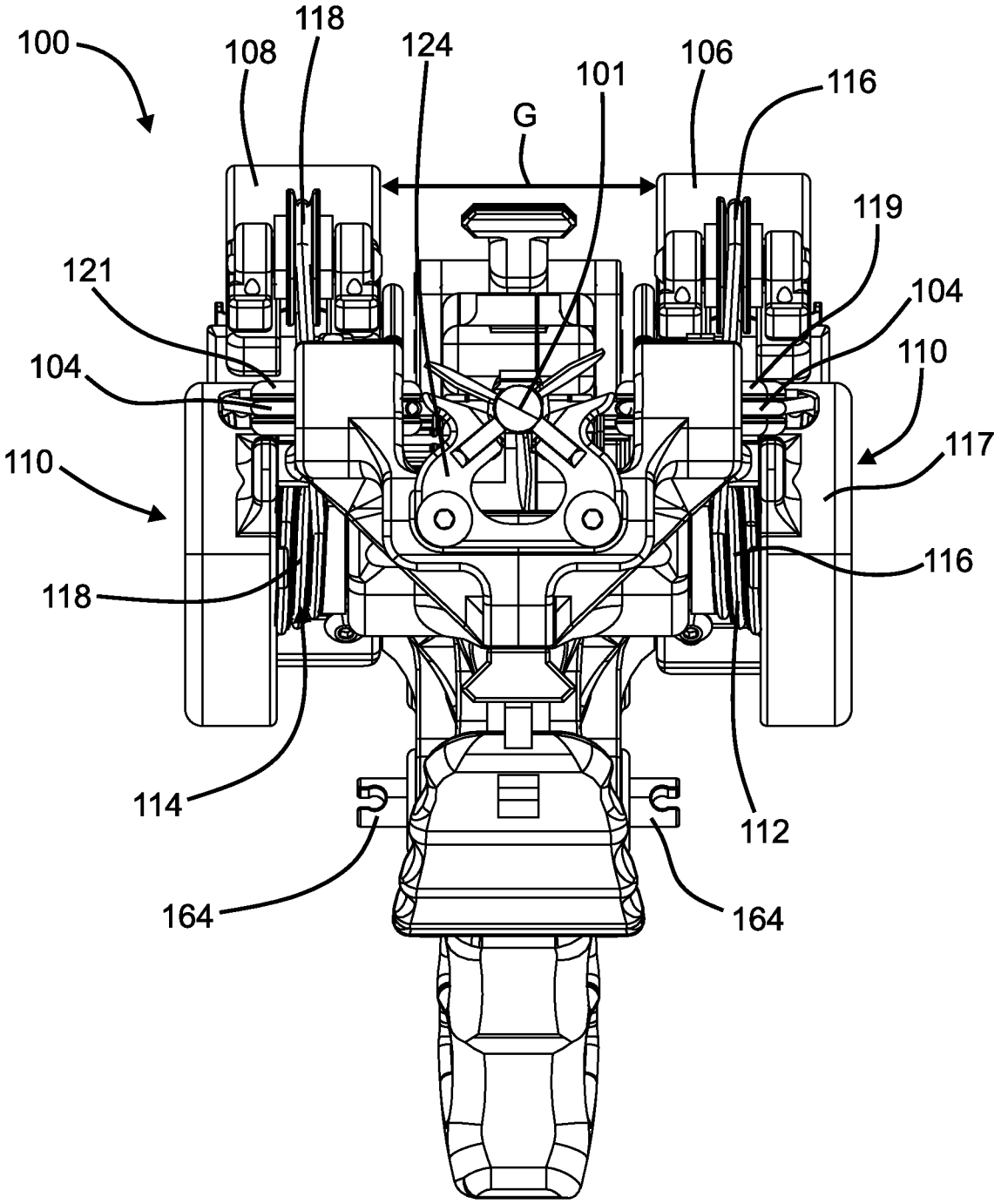
FIG. 13 shows a front view of the projectile launcher of FIG. 5 in the drawn position.
Figure 16:
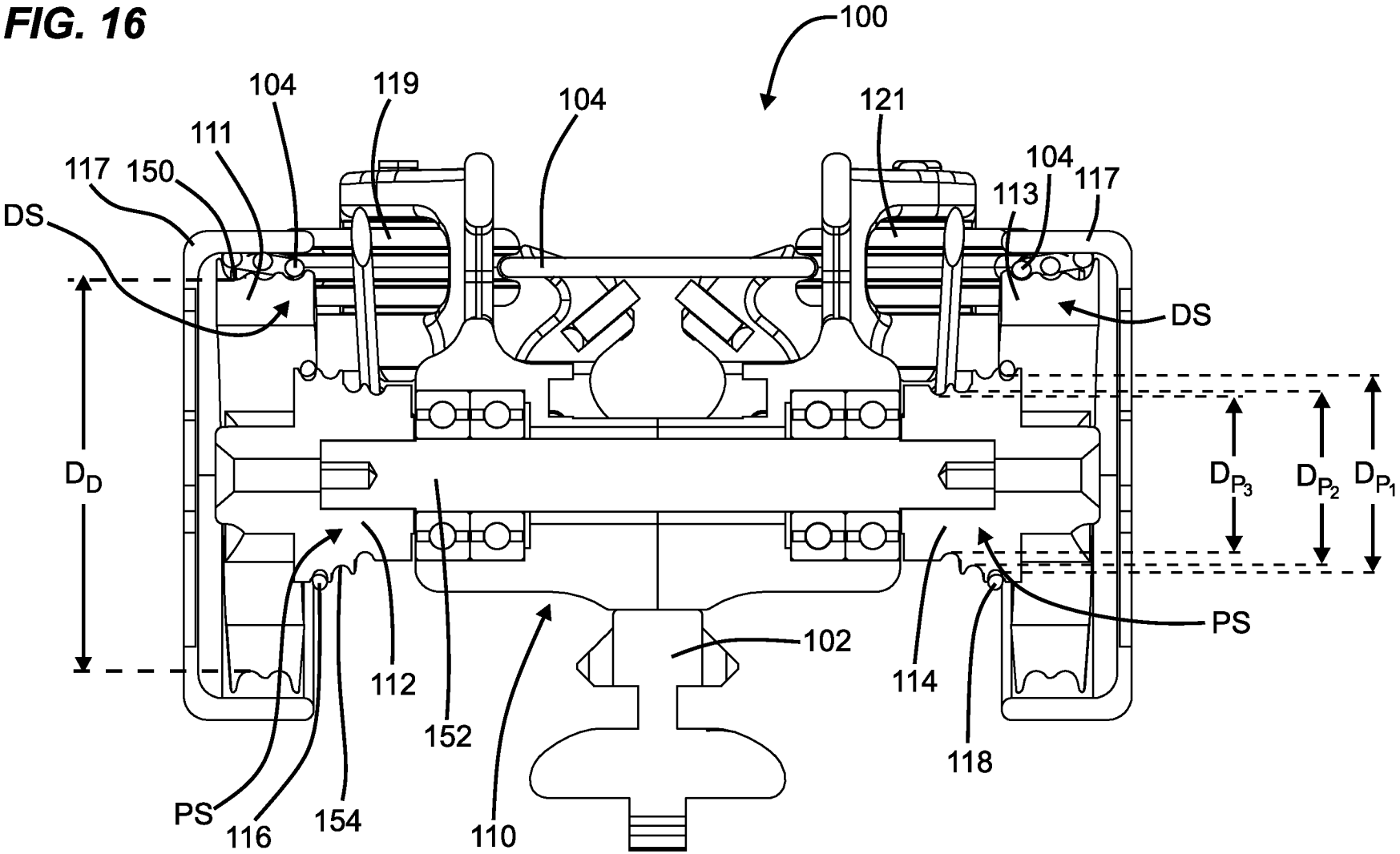
FIG. 16 shows a cross-sectional view along line 16-16 in FIG. 12 of the projectile launcher in the undrawn position.
Figure 17:
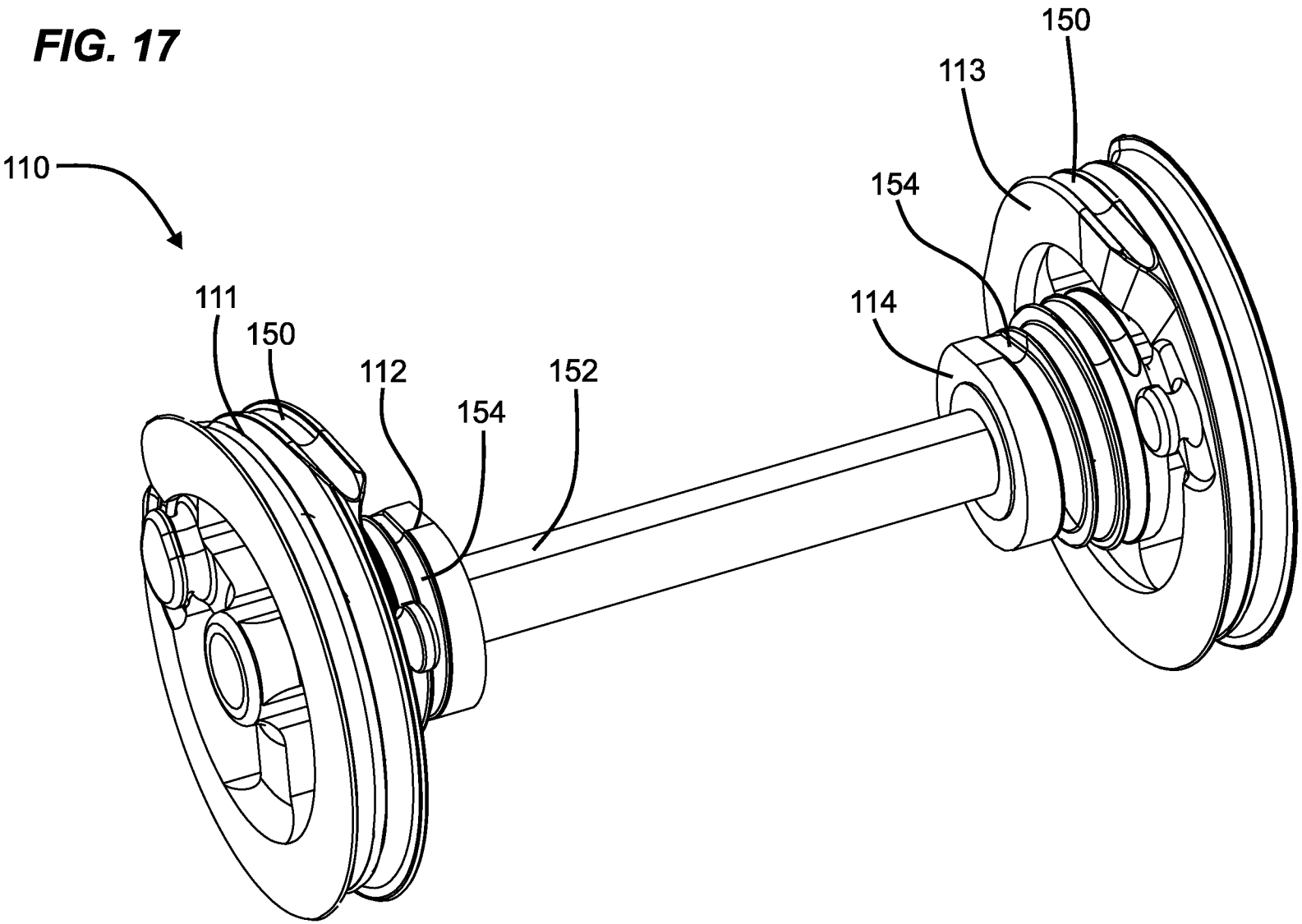
FIG. 17 shows a perspective view of a string hub of a projectile launcher, according to one example of the present disclosure.
Figure 18:
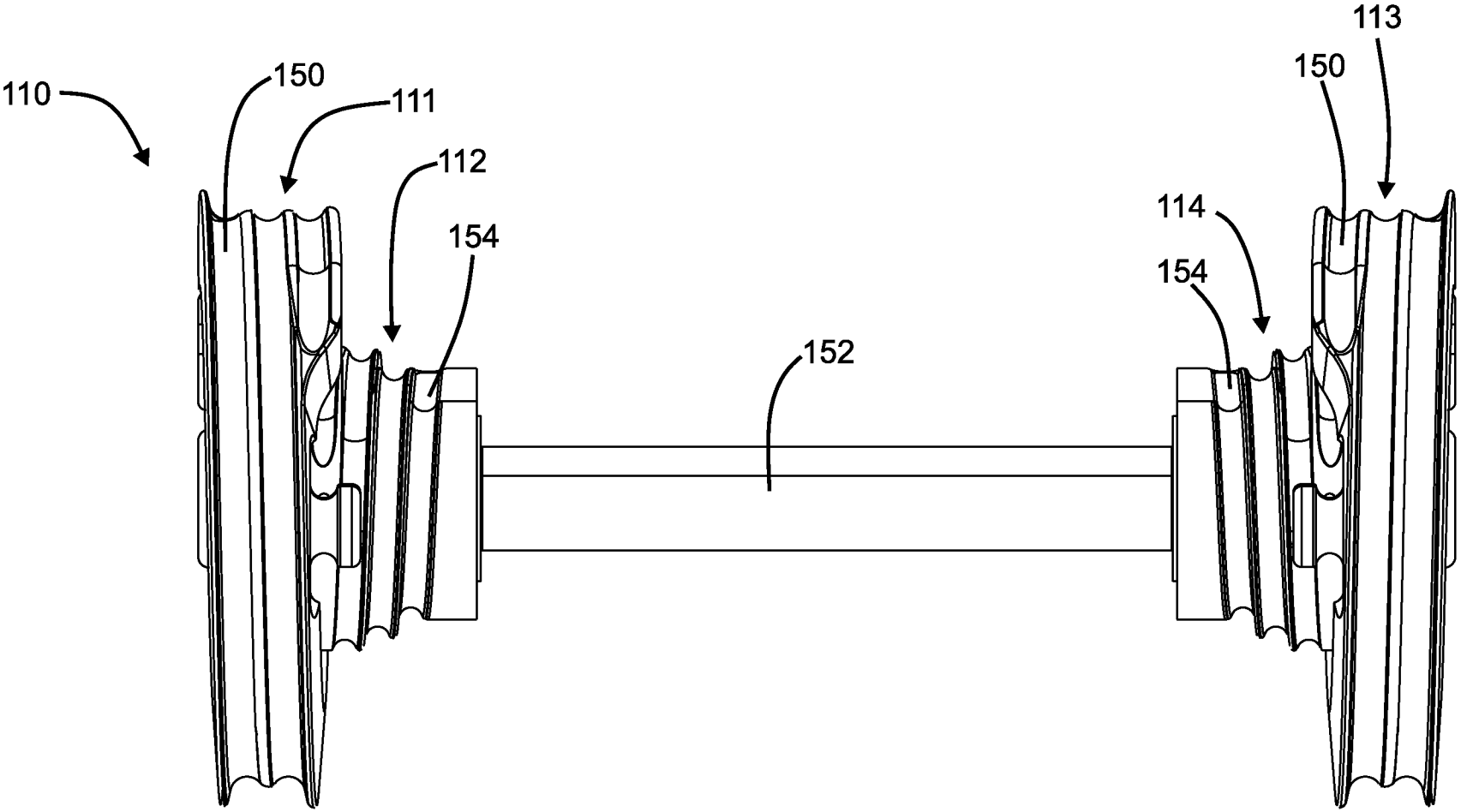
FIG. 18 shows a side view of the string hub of FIG. 17.

FIG. 16 shows a cross-sectional view along line 16-16 in FIG. 12 of the string hub 110. FIGS. 17 and 18 show the string hub 110 removed from the projectile launcher 100. The string hub 110 includes the drawstring wheels 111, 113, the power wheels 112, 114, and a string hub shaft 152. In some examples, the rotation of the string hub 110 can be powered by a power source such as, but not limited to, a spring, a motor, a piston, or like device. Movement of the drawstring 104 away from the string hub 110 corresponds with rotation of the string hub 110 in a first direction, and movement of the drawstring 104 toward the string hub corresponds with rotation of the string hub 110 in a second direction. Rotation of the string hub 110 in the second direction is powered. In some examples, the rotation of the string hub 110 is powered by the first and second limbs 106, 108.

The drawstring wheels 111, 113 are positioned on the outside edges of the string hub 110 and each includes drawstring grooves 150 positioned on the circumferential edge thereof. The drawstring wheels 111, 113 define a drawstring section DS of the string hub 110. In some examples, the drawstring wheels 111, 113 include covers 117 positioned therearound. In some examples, the drawstring wheels 111, 113 include three drawstring grooves 150 apiece and allow for the drawstring 104 to be wrapped around the drawstring wheels 111, 113 three times when the projectile launcher is undrawn. In some examples, the drawstring grooves 150 are connected and spiral to aid in guiding the drawstring 104 around the drawstring wheels 111, 113 to ensure reliable wrapping and unwrapping. In some examples, the drawstring 104 rotates the string hub 110, specifically drawstring wheels 111, 113, approximately 720 degrees about a central axis when the projectile launcher goes from the undrawn position to the drawn position. In some examples, the drawstring grooves 150 are similarly sized. In some examples, the drawstring grooves 150 have similar circumferences. In some examples, the grooves 150 have similar diameters Dd.

The power wheels 112, 114 are positioned adjacent the drawstring wheels 111 113 at a power cable section PS of the string hub 110. In some examples, the power wheels 112, 114 connect to the drawstring wheels 111, 113 at a first side and to the string hub shaft 152 at a second side. The power wheels 112, 114 each include power cable grooves 154 positioned on the outside thereof. In some examples, the power cable grooves 154 can have a stepped configuration, having different outer diameters Dp1, Dp2, Dp3. As shown, Dp1 is greater than Dp2, and Dp2 is greater than Dp3. In some examples, diameters Dd of the drawstring grooves are greater than Dp1, Dp2, and Dp3. The power cable grooves 154 can increase in outer dimeter size as they move toward from the drawstring wheels 111, 113 and away the center of the frame 102. In some examples, this increase in outer diameter, and thereby circumference, ensures that the power cables 116, 118 are unwound around the power wheels 112, 114 at firing at a rate that allows for predictable tension of the drawstring 104. In some examples, this configuration allows for a consistent force curve on the drawstring 104 when the drawstring is fired. In some examples, the power cable grooves 154 in each power wheel 112, 114 decrease in circumference as the respective power cable is wound within the power cable grooves 154 on the respective power wheel 112, 114 as the projectile launcher is moved from the undrawn position to drawn position.

Because the power wheels 112, 114 and drawstring wheels 111, 113 are connected to one another via the string hub shaft 152, they rotate together, thus eliminating timing issues as the projectile launcher 100 is fired.

Figure 19:
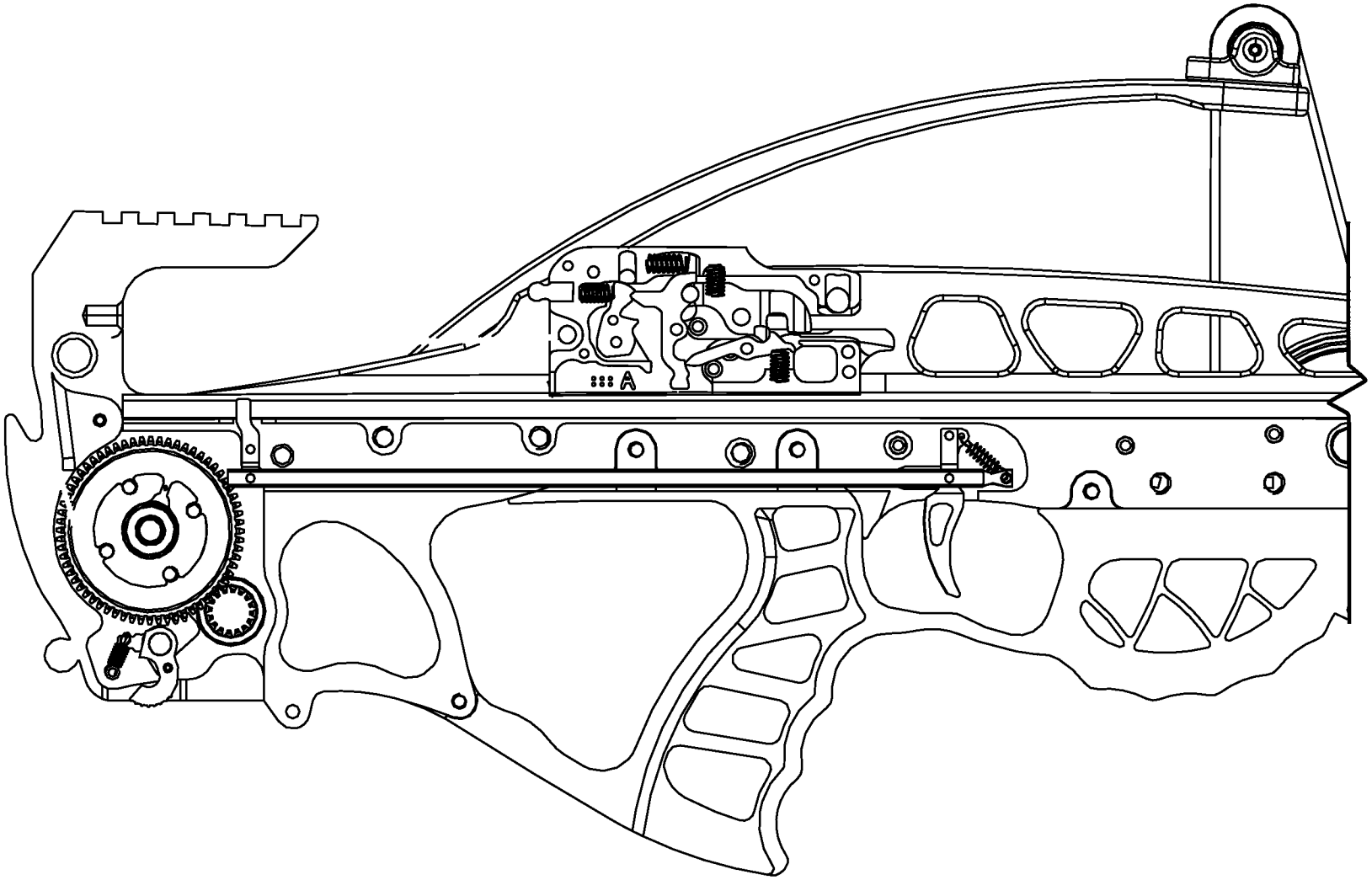
FIG. 19 shows a side view of a longitudinal cross-section of the projectile launcher of FIG. 5 with a tether between a front end and a rear end.

FIG. 19 shows a longitudinal cross-section of the projectile launcher 100 as the latch 120 is between the front 103 and the rear 105 of the frame 102.

Figure 20:
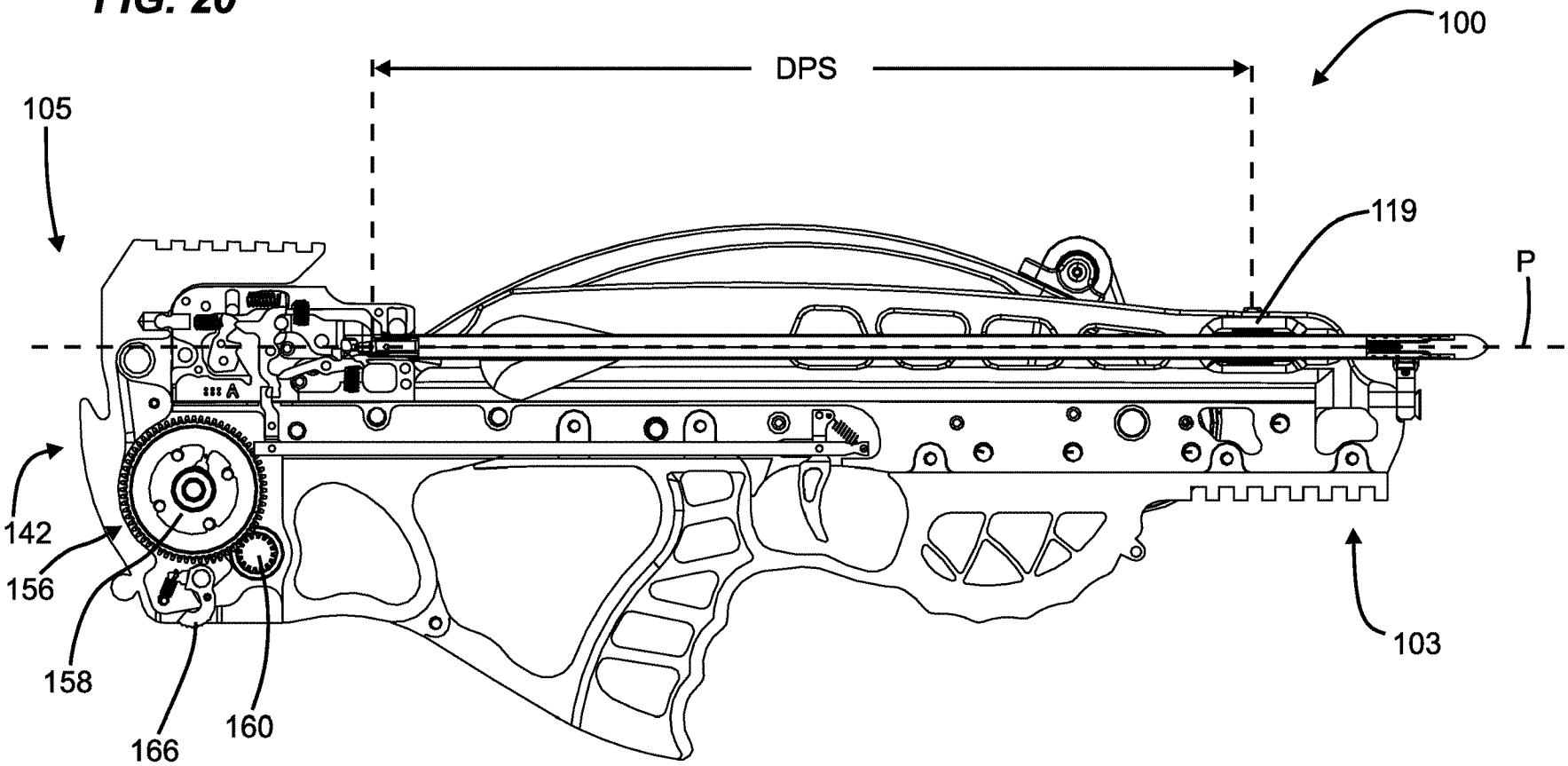
FIG. 20 shows a side view of a longitudinal cross-section of the projectile launcher of FIG. 5 with a tether at the rear end.

FIG. 20 shows the latch 120 attached to the drawstring 104 in the drawn position.

The latch 120 is movable between the rear end 105 of the frame 102 and the front end 103 of the frame 102 along a travel axis T. In some examples, the travel axis T is axially aligned with the projectile axis P. The latch 120 is attached to a crank mechanism 156 via a tether 107. The latch is configured to receive a portion of the projectile 101 therein, as shown in FIG. 20. In some examples, the latch 120 is movable parallel to the projectile axis P. In some examples, the crank mechanism 156 is configured to pull at least a portion of the tether at least partially in a direction perpendicular to the travel axis T. In some examples, the crank mechanism 156 is configured to pull at least a portion of the tether 107 at least partially in a direction perpendicular to the projectile axis P.

Figure 21:
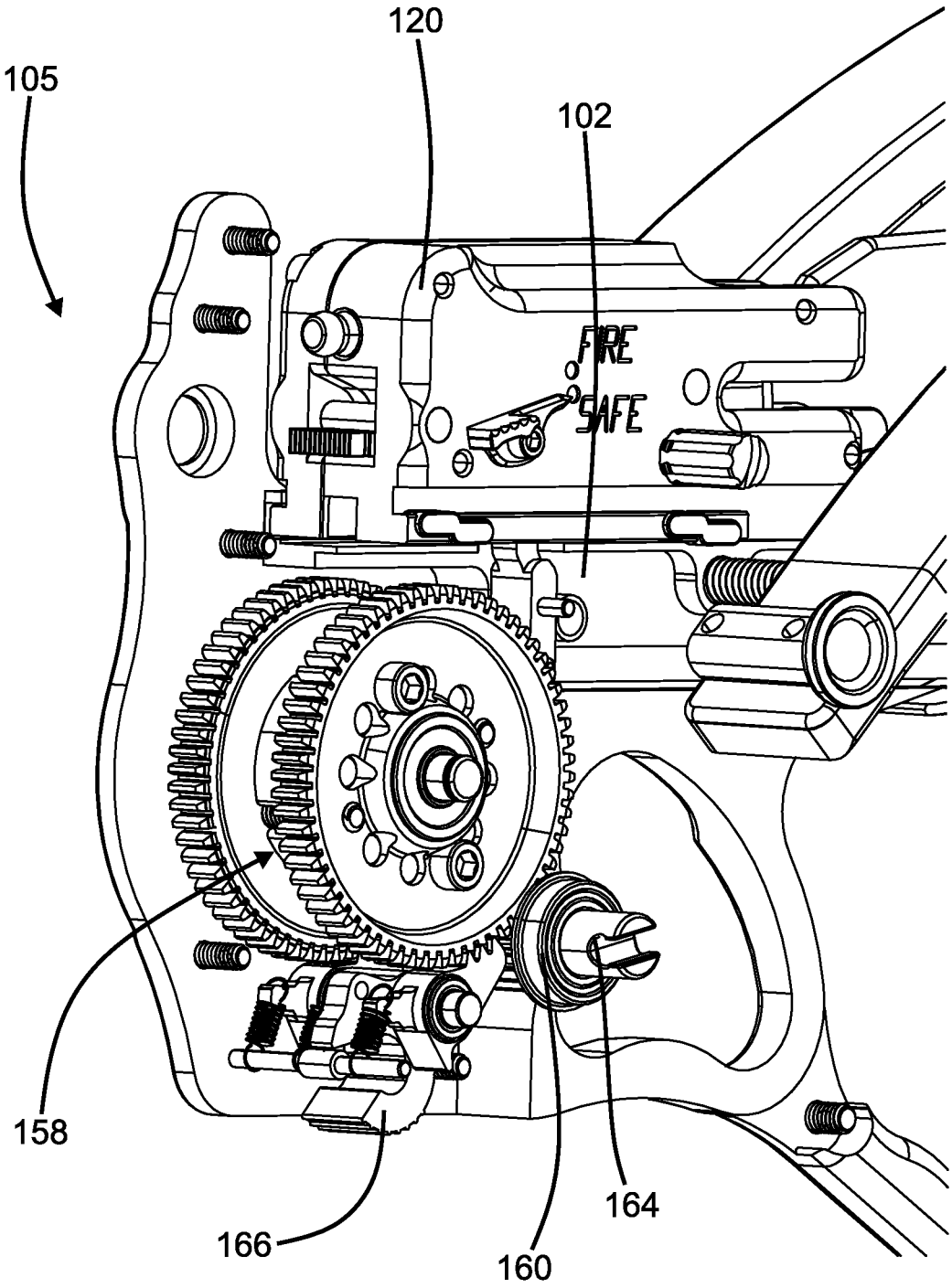
FIG. 21 shows a perspective view of the crank mechanism with part of the frame removed.

FIG. 21 shows a perspective view of the crank mechanism 156 with part of the frame 102 removed. The crank mechanism 156 is housed in the rear 105 of the frame 102. As shown in FIG. 19, the tether 107 travels downward to, and is wound upon, a first gear 158 that is in communication with a second gear 160. In some examples, the tether 107 uses a guide 162 before being wound around the first gear 158. In some examples, the guide 162 is a cylinder. In some examples, the guide 162 is a rotatable shaft. In some examples, the guide 162 includes a bearing. The second gear 160 is rotatable by the arming tool 140 from a post 164, accessible at an exterior of the frame 102. Rotation of the second gear 160, causes rotation of the first gear 158 and wraps the tether 107 therearound. By wrapping the tether 107 around the first gear 158, the latch 120 is moved rearward. In some examples, a first portion A of the tether 107 extends between the guide 162 and the latch 120 in a direction parallel to the travel axis T, and a second portion B of the tether 107 extends between the guide 162 and the crank mechanism 156 at least partially in the direction perpendicular to the travel axis T.

Figure 22:
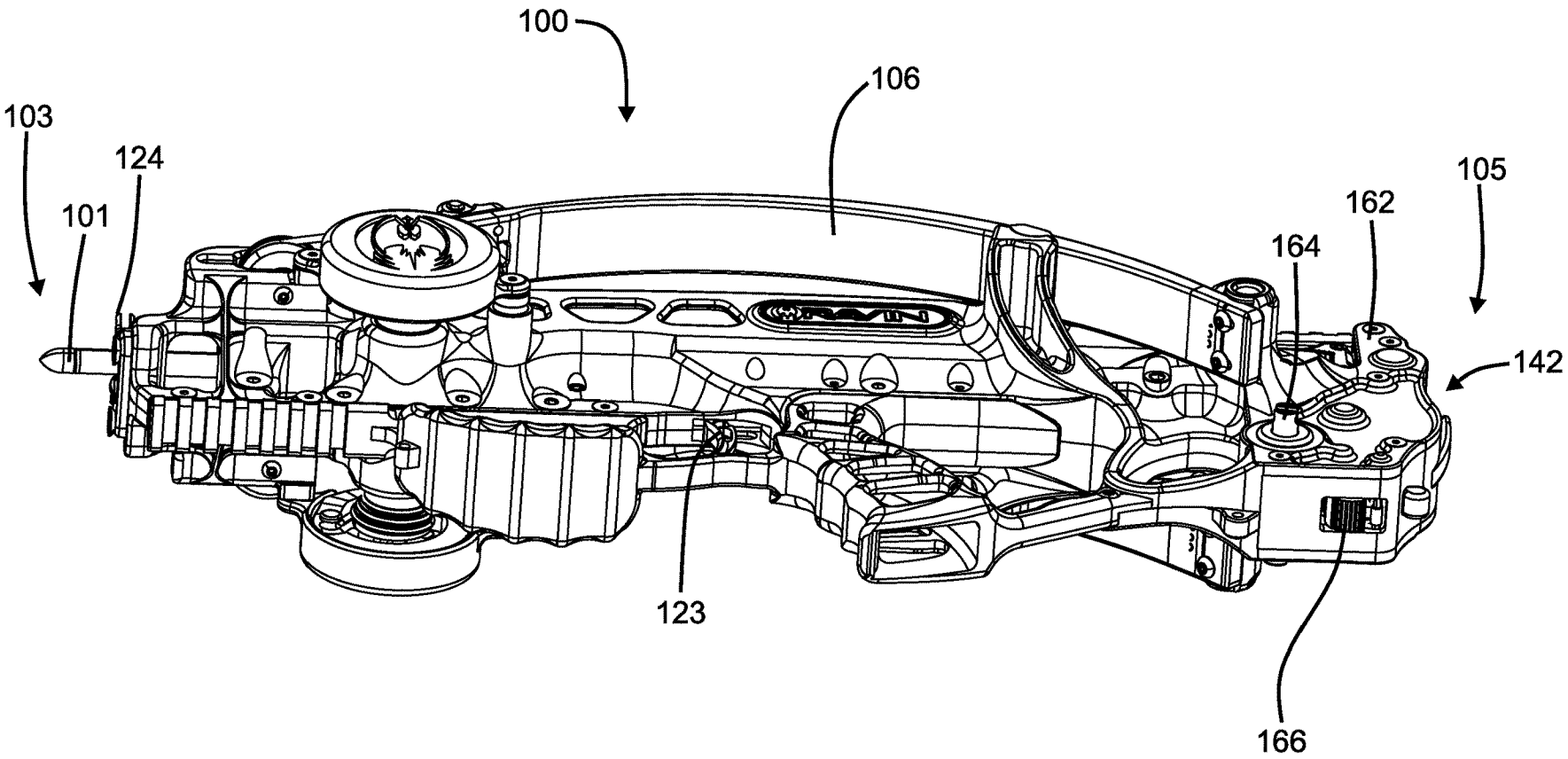
FIG. 22 shows a bottom perspective view of the projectile launcher of FIG. 5.

The crank mechanism 156 also includes a movable stop 166 in communication with the first gear 158. The stop 166 is accessible at the exterior of the frame 102, specifically, at the bottom of the projectile launcher 100, shown in FIG. 22. In some examples, the stop 166 is spring loaded and biased against the first gear 158. In some examples, when the stop 166 is depressed, the stop 166 disengages with the first gear 158 thereby allowing the first gear 158 to rotate so that the tether 107 can be unwound therefrom. In some examples, when winding the tether 107 around the first gear 158, the stop 166 allows the first gear to rotate in a direction where the tether 107 is wound around the first gear 158 but not in a direction where the tether 107 is unwound from the first gear 158. This prevents the drawstring 104 from inadvertently traveling back to the front 103 of the frame 102 during arming. In some examples, the stop 166 is a pawl.

In some examples, the user inverts the projectile launcher 100 to arm. The user can grasp the gripping cutout 132 to stabilize the projectile launcher 100 and the stop 166 is depressed to let out the tether 107, and the latch 120 can then be moved to the front 103 of the frame 102. Once at the front 103, the latch 120 is attached to the drawstring 104 that is positioned against the guides 119, 121. When connected to the drawstring 104, the latch 120 is moved rearward by winding the tether 107 around the first gear 158 by rotating the second gear via the arming tool 140. Once rearward, the latch 120 automatically locks rearward by way of the stop 166. When ready to fire, the user pulls the trigger pull 123 and releases the drawstring 104, and not the latch 120, toward the front 103 of the frame 102.

By positioning the crank mechanism 156 under the latch 120, the projectile launcher 100 is able to utilize a longer drawstring power stroke DPS, shown in FIG. 20, while maintaining a compact size. The drawstring 104 is movable along a power stroke DPS distance when arming and firing the projectile launcher 100. In some examples, the power stroke is in a range from 10 inches to 15 inches. In some examples, the power stroke is 13 inches (33 cm). In some examples, the limbs 106, 108 are upward facing and the guides 119, 121 hold the drawstring 104 in the undrawn position. Because the guides 119, 121 are positioned at the front 103 of the frame 102, in order to draw the drawstring 104, the drawstring 104 must be accessed through the limb gap G, shown in FIG. 13. The latch 120 is configured to pass through the gap G along the frame and grasp the drawstring 104.

Figure 23:
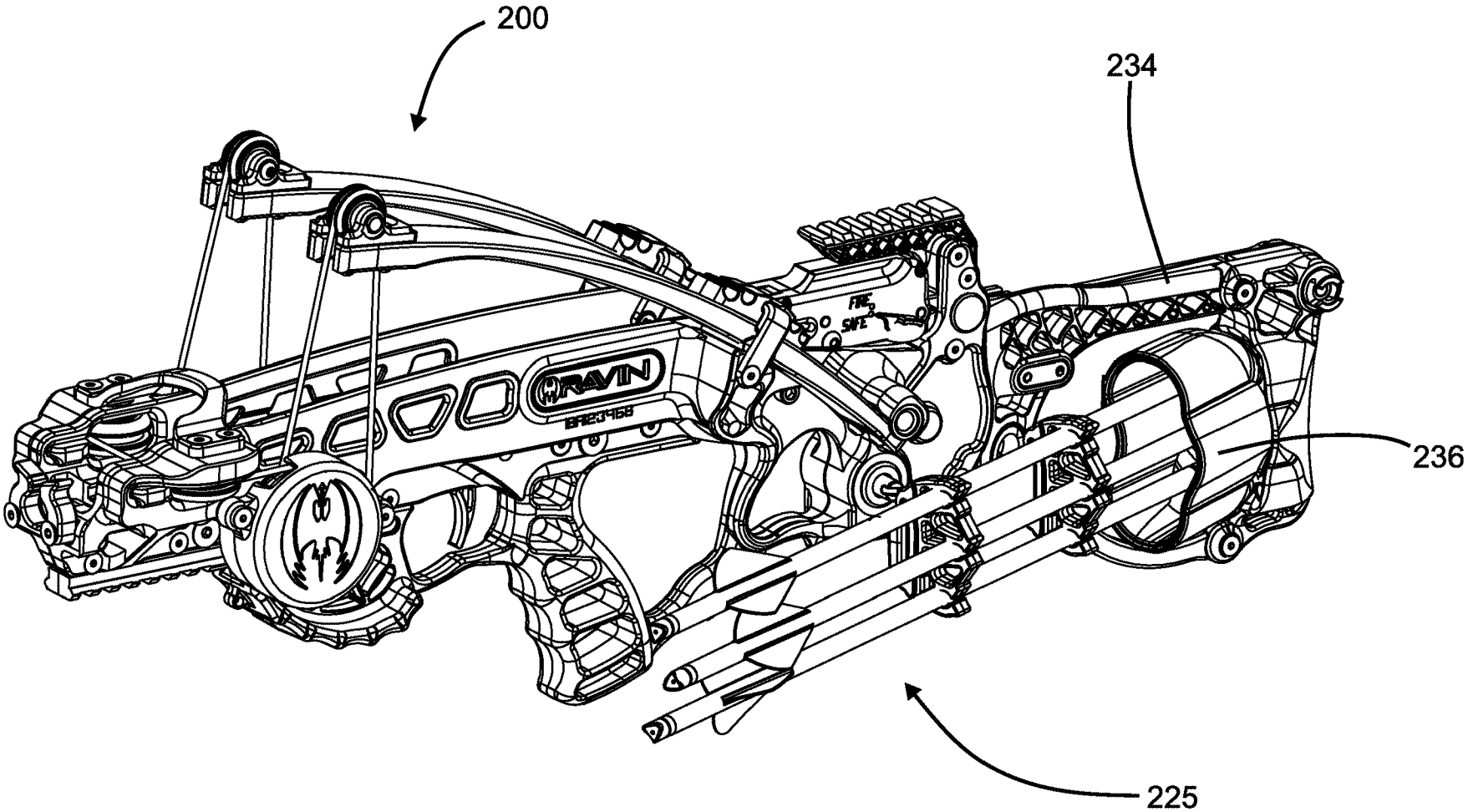
FIG. 23 shows a perspective view of another example weapon system, according to another example of the present disclosure.
Figure 24:
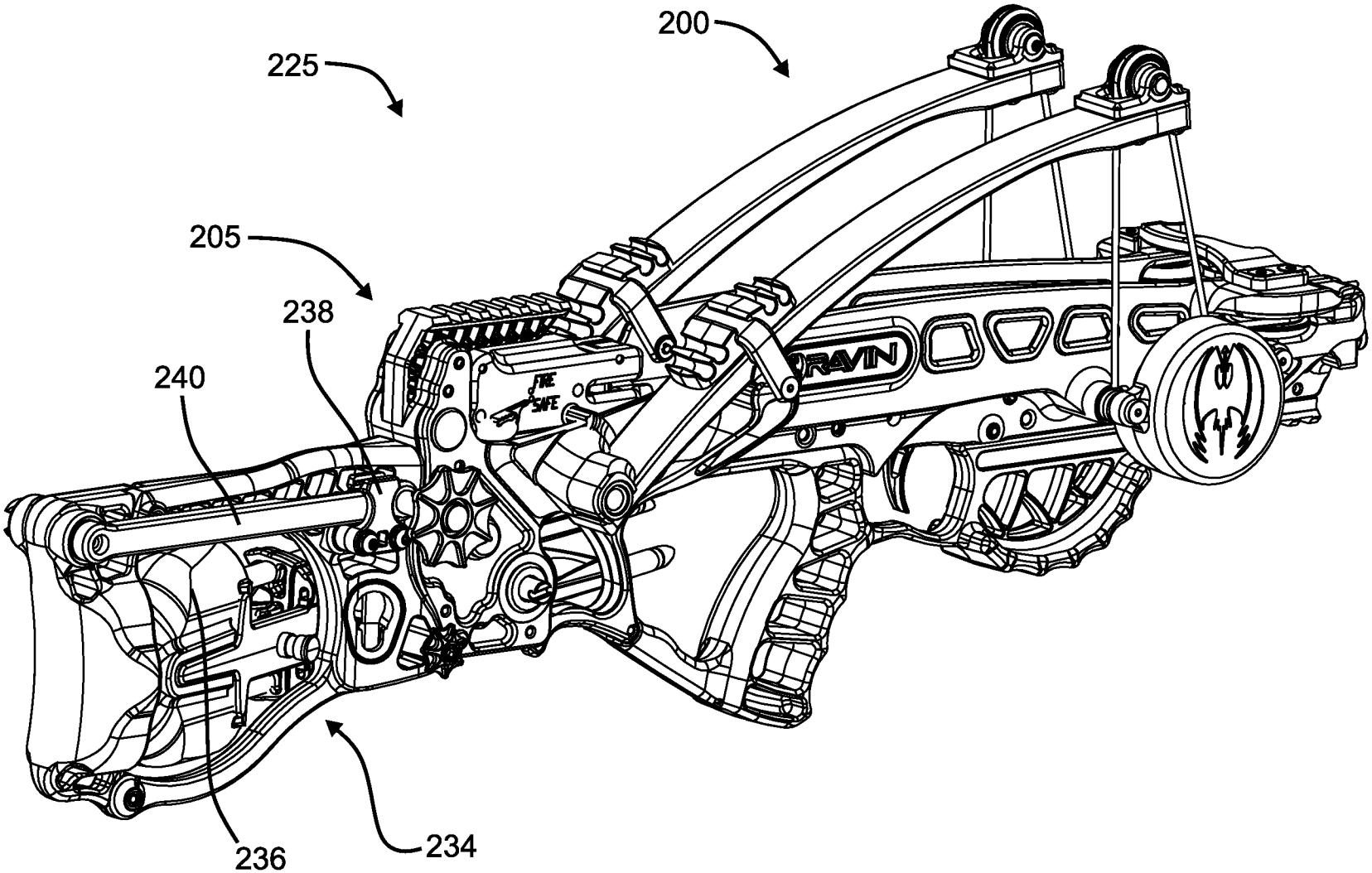
FIG. 24 shows another perspective view of the weapon system of FIG. 23.

FIGS. 23 and 24 show perspective views of another example weapon system 225. The example weapon system 225 and projectile launcher 200 of FIGS. 23 and 24 is capable of being used in a similar manner as described above with reference to the weapon system 125 and projectile launcher 100. As noted above, the weapon system 225 includes a projectile launcher 200 and a stock 234. The stock 234 is shown including a quiver 236 removably attached thereto. In some examples, the stock of the projectile launcher also includes an arming tool 240, and a storage area 238 for an arming tool 240. In some examples, the component parts of the weapon system 225 are all detachable, as outlined above, and as seen in in FIG. 25.

Figure 25:
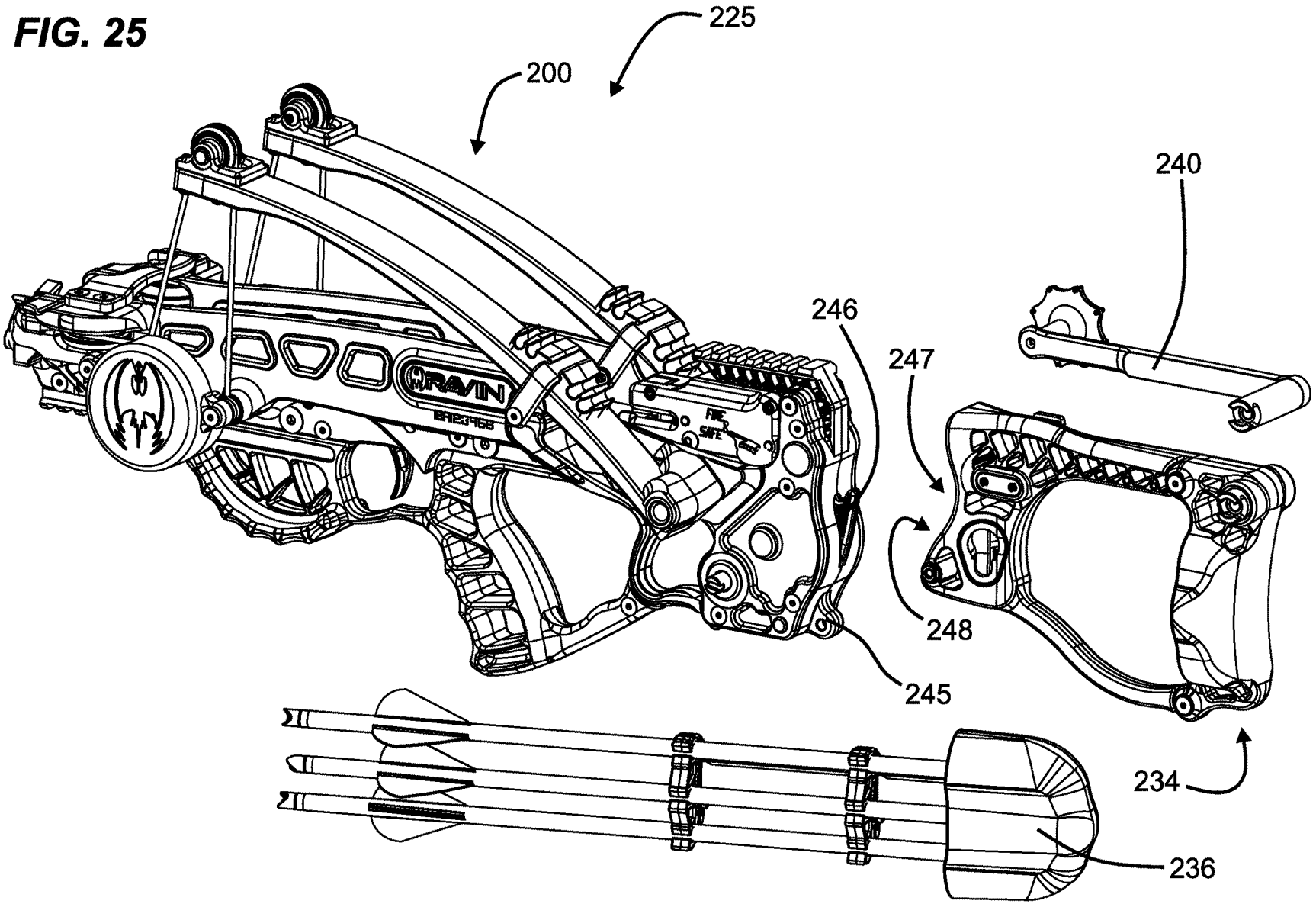
FIG. 25 shows an exploded view of the weapon system of FIG. 23.

FIG. 25 shows an exploded perspective view of the example weapon system 225 of FIGS. 23 and 24. As depicted in FIG. 25, the component parts of the example weapon system 225 can be taken apart and disassembled for storage or added maneuverability. In some embodiments, the weapon system 225 includes a rear interface and mating stock interface, as previously described above with reference to FIGS. 6, 14, and 15. In some examples, each of the hook recess 247, post recess 248, hook 246, and post 245, described above with reference to FIG. 6, may be alternatively located on the projectile launcher 200 or the stock 234 of the example weapon system 225.

Figure 26:
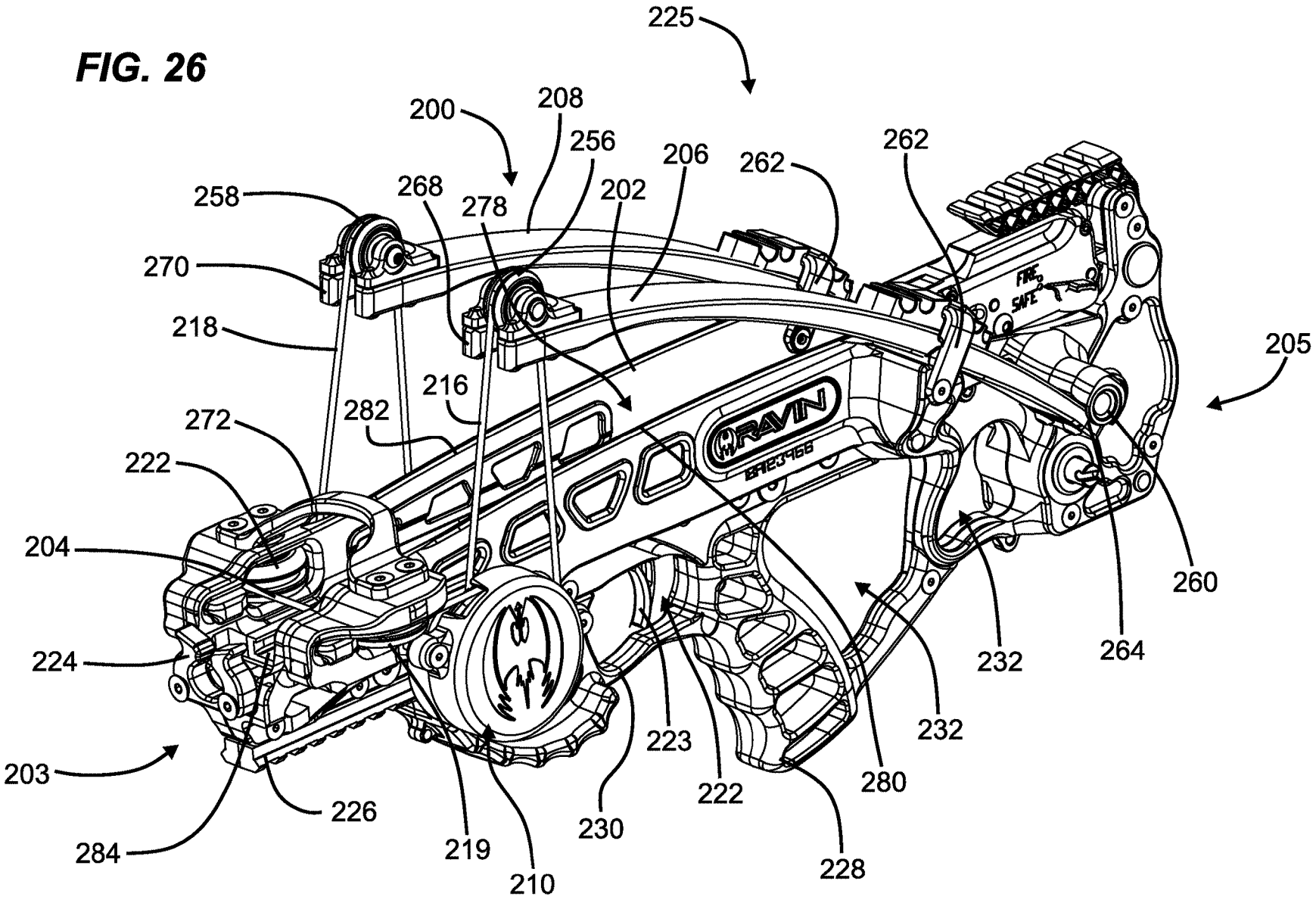
FIG. 26 shows a perspective view of a projectile launcher in the undrawn position, according to another example of the present disclosure.
Figure 27:
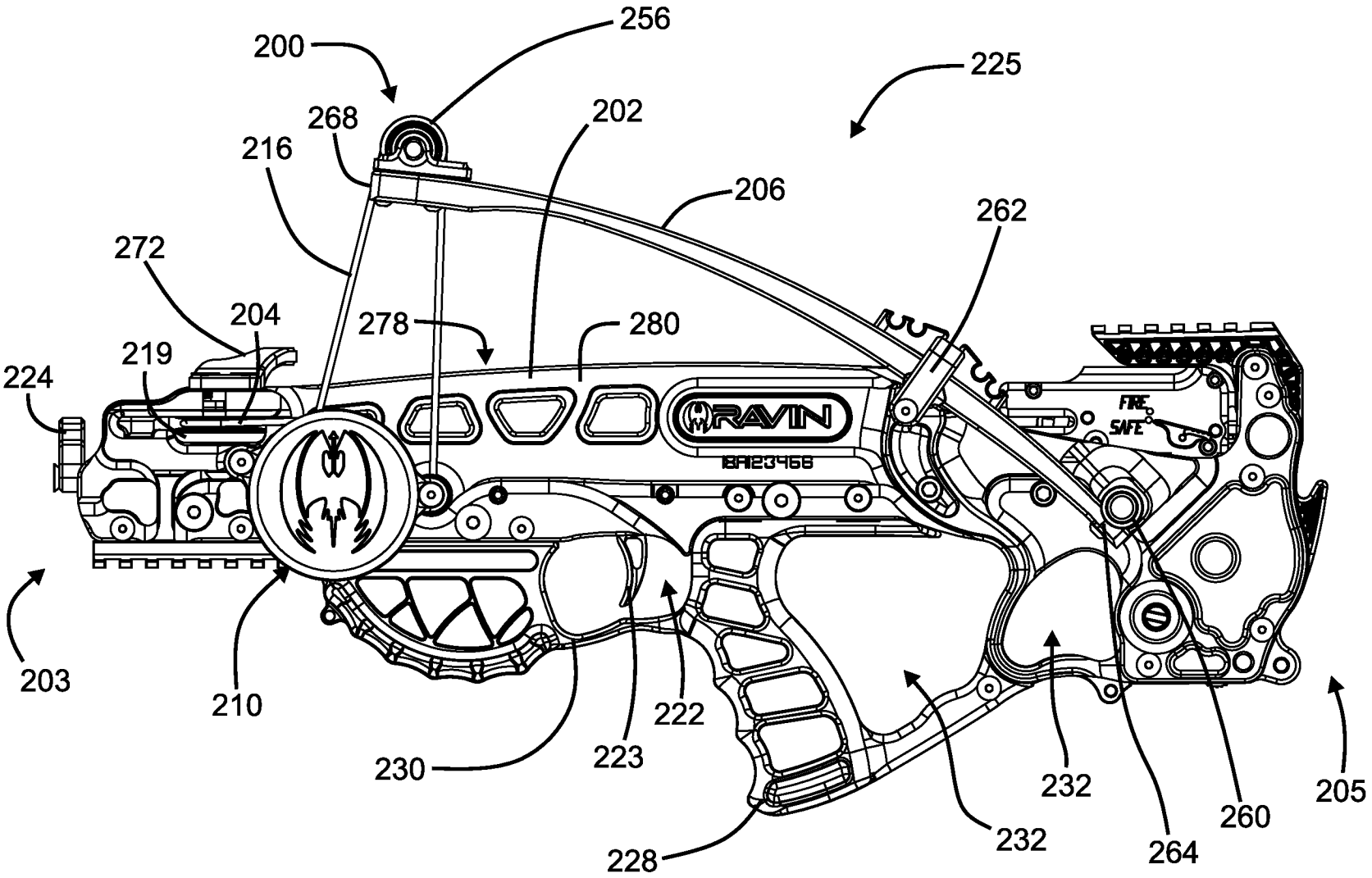
FIG. 27 shows a left side view of the projectile launcher of FIG. 26 in the undrawn position.
Figure 28:
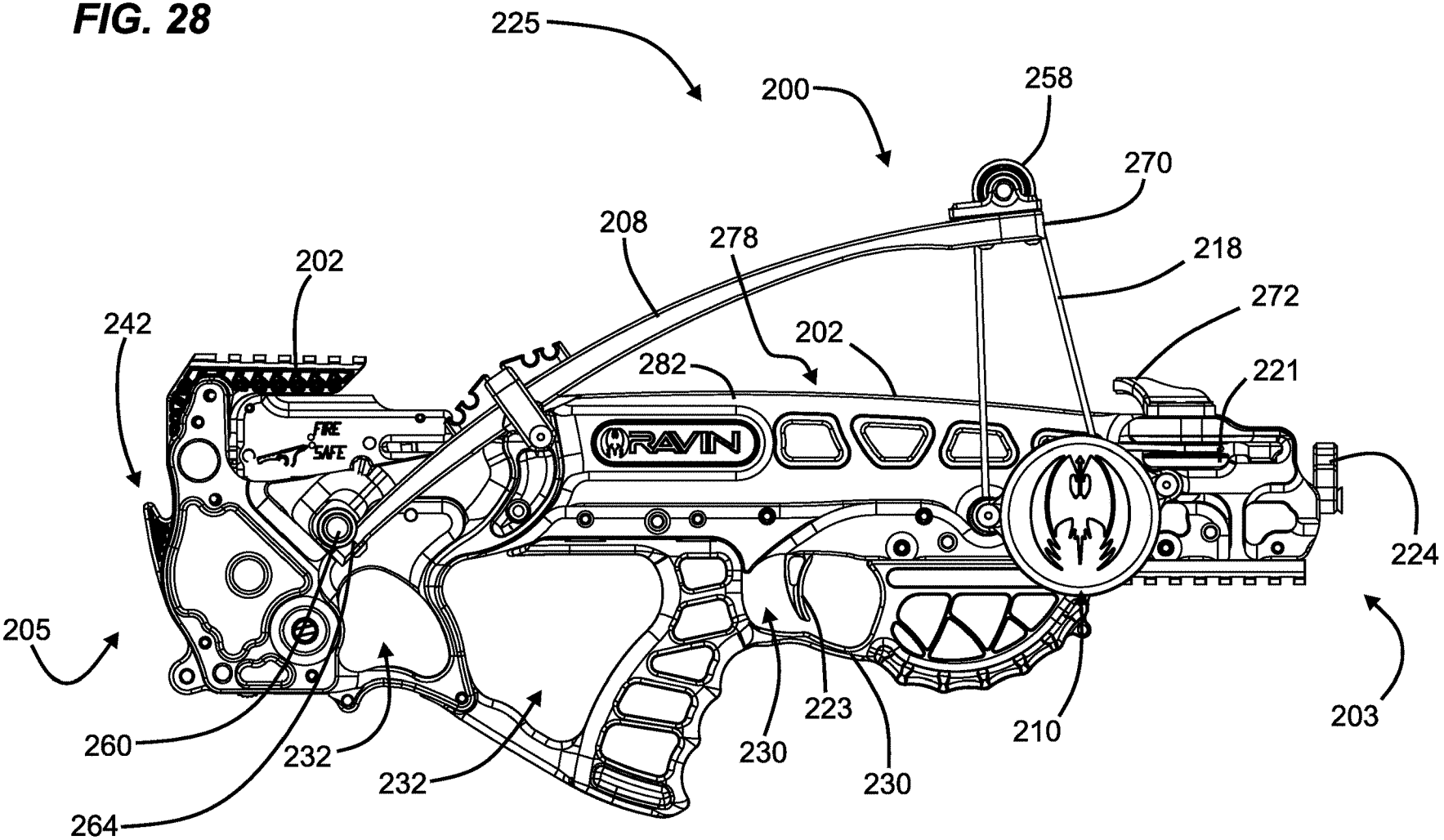
FIG. 28 shows a right side view of the projectile launcher of FIG. 26 in the undrawn position.
Figure 29:
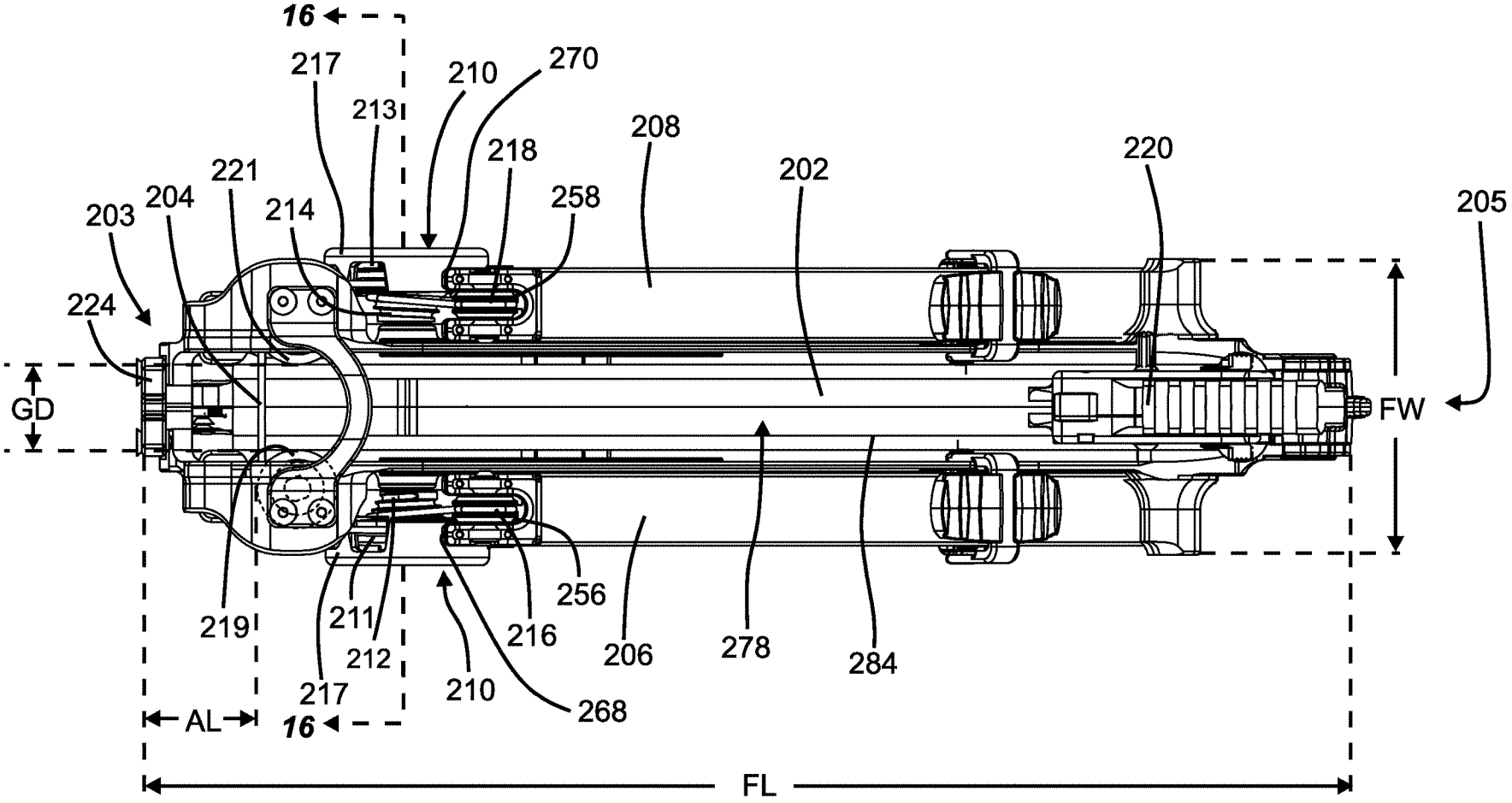
FIG. 29 shows a top view of the projectile launcher of FIG. 26 in the undrawn position.

FIGS. 26-29 depict the example projectile launcher 200 in an undrawn position. FIG. 26 is a perspective view of the example projectile launcher 200. FIG. 27 is a left view of the example projectile launcher 200, FIG. 28 is a right view of the example projectile launcher 200, and FIG. 29 is a top view of the example projectile launcher 200. As seen in FIGS. 26-29, in some embodiments, the left and right sides of the projectile launcher 200 are symmetrical. In some examples, the projectile launcher 200 includes a frame 202 with a front end 203 and a rear end 205. In some examples, the projectile launcher 200 further includes a drawstring 204, a first limb 206, a second limb 208, a string hub 210, a first power cable 216, a second power cable 218, a first drawstring guide 219, a second drawstring guide 221, a latch 220, a trigger assembly 222, an arrow rest 224, an accessory rail 226, a grip 228, a trigger guard 230, and a gripping cutout 232.

In some examples, the limbs 206, 208, include first ends 264, 266, second ends, 268, 270, and limb pulleys 256, 258. The limbs 206, 208 power the string hub 210 and the power cables 216, 218, which transmit power through the string hub 210 to the drawstring 204. In some examples, the limbs 206, 208 are elastic and spring-like in nature. In some examples, a single limb can be utilized. In some examples, the limbs 206, 208 extend in an upward direction from a top side of the frame 202 and in a forward direction toward the front end 203 of the frame 202. In some examples, the limbs 206, 208, include the limb pulleys 256, 258 at their second ends 268, 270. It is considered within the scope of the present disclosure that the limbs 206, 208 may be positioned in a variety of different ways relative to the frame 202. In some examples, the limbs 206, 208 are supported at their first ends 264, 266, by distal limb supports 260 and are supported along their length by medial limb supports 262. In some examples, the medial limb supports 262 act as a fulcrum upon which the limbs 206, 208 bend as the second ends 268, 270 of the limbs 206, 208 are drawn downward. In some examples, the medial limb supports 262 and distal limb supports 260 are both located rearward of the trigger pull 223 of the trigger assembly 222. In other examples, the medial limb support 262 is located forward of the trigger pull 223 of the trigger assembly 222 while the distal limb support 260 is located rearward of the trigger pull 223 of the trigger assembly 222. In other examples, both the medial limb supports 262 and distal limb supports 260 are located forward of the trigger pull 223 of the trigger assembly 222.

An example embodiment of the projectile launcher includes a frame having a vertical grip, the frame defining a horizontal projectile plane at a top side in which a projectile axis is positioned, wherein a projectile moves within the horizontal projectile plane and along the projectile axis during firing and arming of the projectile launcher, wherein the projectile is fired from a front end of the frame, and wherein the frame includes a limb with a distal limb support and a medial limb support.

Another example includes, alone or in combination with the above example, the distal and medial limb supports being positioned rearward of a trigger for firing the projectile launcher.

Another example includes, alone or in combination with any of the above examples, the distal limb support being positioned rearward of the trigger while the medial limb support is positioned in front of the trigger.

The frame 202 may be made of the same materials of the frame 102. Likewise, the frame 202 may be made of multiple portions. In some examples, the frame 202 includes two symmetrical halves that mate together along the longitudinal axis of the frame 202.

In some examples, the frame 202 is built to minimize the length of the frame 202 between the front end 203 and the rear end 205 of the frame 202, or minimize the width of the frame 202 between its left side and right side. In some examples, the length FL of the frame 202 is in a range from about 15 inches to about 23 inches (or from 15 inches to 23 inches) (38 cm to 58 cm) between the front end 203 and rear end 205 of the frame 202. In some examples, the length FL of the frame 202 is in a range from about 18 inches to about 20 inches (or from 18 inches to 20 inches) (45 cm to 51 cm) between the front end 203 and rear end 205. In other examples, the length FL of the frame 202 is in a range from about 18 inches to about 19 inches (or 18 inches to 19 inches) (45 cm to 49 cm) between the front end 203 and rear end 205. In other examples, the length FL of the frame 202 is about 18.75 inches (or is 18.75 inches) (47.6 cm) between the front end 203 and rear end 205. In some examples, the width FW of the frame 202 is in a range from about 1 inch to about 10 inches (or from 1 inch to 10 inches) (2.5 cm to 26 cm) between its left and right sides. In some examples, the width FW of the frame 202 is in a range from about 1 inch to about 6 inches (or from 1 inch to 6 inches) (2.5 cm to 15 cm) between its left and right sides. In some examples, the width FW of the frame 202 is in a range from about 3 inches to about 5 inches (or from 3 inches to 5 inches) (7.5 cm to 13 cm) between its left and right sides.

An example embodiment of the projectile launcher includes a frame having a vertical grip, the frame defining a horizontal projectile plane at a top side in which a projectile axis is positioned, wherein a projectile moves within the horizontal projectile plane and along the projectile axis during firing and arming of the projectile launcher, wherein the projectile is fired from a front end of the frame, and wherein the frame has a length between the front end and the rear end of the frame in a range from about 15 inches to about 23 inches (or from 15 inches to 23 inches) (38 cm to 58 cm).

Another example includes, alone or in combination with the above example, wherein the frame has a length between front and rear ends of the frame in a range from about 18 inches to about 19 inches (or from 18 inches to 19 inches) (45 cm to 49 cm).

Another example includes, alone or in combination with any of the above examples, wherein the frame has a length of about 18.75 inches (or a length of 18.75 inches) (47.6 cm) between the front and rear ends of the frame.

Another example includes, alone or in combination with any of the above examples, wherein the frame has a width between the left and right sides of the frame in a range from about 1 to about 10 inches (or from 1 to 10 inches) (2.5 cm to 26 cm).

Another example includes, alone or in combination with any of the above examples, wherein the frame has a width between the left and right sides of the frame in a range from about 1 to about 6 inches (or from 1 inch to 6 inches) (2.5 cm to 15 cm).

Another example includes, alone or in combination with any of the above examples, wherein the frame has a width between the left and right sides of the frame in a range from about 3 to about 5 inches (or from 3 inches to 5 inches) (7.5 cm to 13 cm). Another example has a frame width of about 4.9 inches (12.4 cm).

In some examples, the frame 202 includes a reinforcement arch 272. the reinforcement arch 272 extends over the projectile axis P between the left and right sides of the projectile launcher 200 and provides reinforcement to the frame 202. In some examples, the reinforcement arch 272 prevents the left and right sides of the frame 202 from collapsing inward towards the projectile axis P and the middle of the frame 202 when the drawstring 204 is under tension. In some examples, the reinforcement arch 272 serves further functions such as keeping a knocked arrow or other projectile from falling out of place as the projectile launcher 200 is moved in space by a user. The reinforcement arch 272 may also help to keep objects and body parts away from the projectile axis P.

An example embodiment of the projectile launcher includes a frame having a vertical grip, the frame defining a horizontal projectile plane at a top side in which a projectile axis is positioned, wherein a projectile moves within the horizontal projectile plane and along the projectile axis during firing and arming of the projectile launcher, wherein the projectile is fired from a front end of the frame, and wherein a reinforcement arch extends over and traverses the projectile axis and connects to the frame on either side of the projectile axis.

In some examples, the projectile launcher 200 also includes an arrow rest 224 mounted to the frame 202. In some examples, as seen in the examples of FIGS. 26-30, the arrow rest 224 is positioned forward of the drawstring guides 219, 221 and mounted to the front end 203 of the frame 202 of the projectile launcher 200. In some examples, the distance AL between the arrow rest 224 and the front edge of the drawstring guides 219, 221 is in a range from about 0 inches to about 4 inches (or 0 inches to 4 inches) (0 cm to 10 cm). In another example, the distance AL between the arrow rest 224 and the front edge of the drawstring guides 219, 221 is in a range from about 0 inches to about 3 inches (or 0 inches to 3 inches) (0 cm to 7.5 cm). In some examples, the distance AL between the arrow rest 224 and the front edge of the drawstring guides 219, 221 is about 1.47 inches (or is 1.47 inches) (3.73 cm). In other examples, the arrow rest 224 is positioned rearward of the drawstring guides 219, 221 and is retractable. In such examples, the arrow rest 224 is in an upright position and supports the arrow while the drawstring 204 is carried rearward by the latch 220, and retracts into the projectile plane when the projectile is fired. The arrow rest 224 may be manufactured from a variety of materials including, for example, plastics, metals, and composite materials.

In some embodiments, the drawstring guides 219, 221 are spaced apart from each other on either side of the projectile axis. The drawstring 204 wraps partially around the drawstring guides 219, 221 within a groove around each drawstring guide 219, 221, so that a portion of the drawstring 204 extends between each of the drawstring guides 219, 221. As this portion of the drawstring 204 is pulled rearward during the loading of the projectile launcher 200, each drawstring guide 219, 221 rotates in a first direction, and as the portion is released and propelled forward, each drawstring guide 219, 221 rotates in a second direction.

The drawstring guides 219, 221 may be various sizes and positioned in various ways on the projectile launcher 200. In some embodiments, the drawstring guides 219, 221 have an outer diameter in a range from about 0.5 inches to about 2 inches (or 0.5 inches to 2 inches) (1.25 cm to 5 cm) in diameter. In other embodiments, the drawstring guides 219, 221 have an outer diameter of about 1.35 inches (or of 1.35 inches) (3.43 cm). In some embodiments, the drawstring guides 219, 221 have an inner diameter, as measured around the inner-most portion of the groove of the drawstring guide 219, 221, that is less than the outer diameter of the drawstring guides 219, 221. In some embodiments, this inner groove diameter is in a range from about 0.5 inches to about 2 inches (or 0.5 inches to 2 inches) (1.25 cm to 5 cm) in diameter. In some embodiments, the inner groove diameter is about 1.05 inches (or is 1.05 inches) (2.67 cm).

Likewise, in some examples, the drawstring guides 219, 221 are positioned at varying distances from each other. For example, in some embodiments, the distance between the two drawstring guides GD, as measured from a point on the outer diameter of each drawstring guide 219, 221, is in a range from about 1 inch to about 4 inches (or 1 inch to 4 inches) (0 cm to 10 cm). In some examples, the distance between the two drawstring guides GD is in a range from about 1 inch to about 1.5 inches (or from 1 inch to 1.5 inches) (2.5 cm to 3.8 cm). In some examples, the distance between the two drawstring guides GD is about 1.325 inches (or is 1.325 inches) (3.37 cm).

FIG. 29 also includes a dashed line, showing the diameter of the drawstring guide 219, obstructed by the frame 202. The drawstring guide 221 is shaped equivalently to the drawstring guide 219. In some examples, the drawstring guides 219, 221 are sized small enough, and positioned close enough to one another, so that the outer edge of the diameter of the drawstring guides 219, 221 is positioned closer to a central plane of the projectile launcher 200 (defined by a vertical plane positioned along the projectile axis) than the outer edge of the limbs 206, 208. Thus, the outer edges of the limbs 206, 208 are positioned distal to the outer edges of the drawstring guides 219, 221 and the drawstring guides 219, 221 are positioned medial to the outer edges of the limbs 206.

In some examples, the drawstring 204 includes a knocking portion that extends between the first drawstring guide 219 and the second drawstring guide 221. In some examples, the drawstring guides 219, 221 are cams or pulleys, and spin as the knocking portion of the drawstring 204 travels forward or rearward along the projectile axis P. In some examples, the drawstring 204 is routed around the drawstring guides 219, 221 into the string hub 210.

In some examples, the frame 202 defines a projectile track 278. The projectile track 278 includes a left sidewall 280, a right sidewall 282, and a bottom 284. The projectile axis P is positioned within the projectile track 278. The latch 220 is configured to move forward and rearward within the projectile track 278 during the loading and firing of the projectile launcher 200. In some examples, the latch 220 must be compact in size as to fit within the projectile track 278 and move in the forward and rearward directions. In some examples, the projectile track 278 is less than about 2 inches wide (or less than two inches (5 cm) wide), as measured between the left sidewall 280 and right sidewall 282. In such cases, the latch 220 is sized to be less than about 2 inches wide (or less than 2 inches (5 cm) wide) so that it can fit between the left sidewall 280 and the right sidewall 282 and move forward and rearward within the projectile track 278. In some examples, the latch 220 is sized so that there is about a 0.03 inch (or a 0.03 inch) (0.76 cm) clearance between the sides of the latch 220 and the sidewalls 280, 282.

An example embodiment of the projectile launcher includes a frame having a vertical grip, the frame defining a horizontal projectile plane at a top side in which a projectile axis is positioned, wherein a projectile moves within the horizontal projectile plane and along the projectile axis during firing and arming of the projectile launcher, wherein the projectile is fired from a front end of the frame, and wherein the frame includes an arrow rest positioned to support an projectile.

Another example includes, alone or in combination with the above example, a plurality of pullies between which a drawstring extends, wherein the arrow rest is positioned in front of the plurality of pullies.

Another example includes, alone or in combination with any of the above examples, a plurality of drawstring guides between which a drawstring extends, wherein the arrow rest is positioned behind the plurality of pullies.

Another example includes, alone or in combination with any of the above examples, a portion of the drawstring spanning between the drawstring guides in direction perpendicular to the projectile axis, wherein the arrow rest is positioned in a range from about 0 inches to about 4 inches (or 0 inches to 4 inches) (0 cm to 10 cm) in front of the portion of the drawstring.

Another example includes, alone or in combination with any of the above examples, a portion of the drawstring spanning between the drawstring guides in direction perpendicular to the projectile axis, wherein the arrow rest is positioned in a range from about 0 inches to about 4 inches (or 0 inches to 4 inches) (0 cm to 10 cm) in front of the portion of the drawstring.

Another example includes, alone or in combination with any of the above examples, an arrow rest is positioned in a range from about 0 inches to about 4 inches (or from 0 inches to 4 inches) (0 cm to 10 cm) in front of the portion of the drawstring.

Another example includes, alone or in combination with any of the above examples, an arrow rest is positioned about 1.47 inches (or is positioned 1.47 inches) (3.73 cm) in front of the portion of the drawstring.

Another example includes, alone or in combination with any of the above examples, the projectile launcher, wherein the frame defines a projectile track with a bottom, a left sidewall, and a right sidewall, wherein the projectile axis is positioned within the projectile track.

Another example includes, alone or in combination with any of the above examples, the projectile launcher, wherein a latch is configured to move within the projectile track along the projectile axis, wherein the latch includes a left and a right side, wherein the left and right sides of the latch are spaced about 0.03 inches (or are spaced 0.03 inches) (0.76 cm) from the left and right sidewalls when the latch moves within the projectile track along the projectile axis.

The drawstring 204 can be constructed of traditional bowstring material such as, but not limited to, composite and/or natural fibers. Likewise, the power cables 216, 218 can be constructed of a variety of different materials such as, but not limited to, composite and/or natural fibers, metal, plastic, etc. In some examples, the power cables 216, 218 are attached to and/or wound around the first and second limbs 206, 208. In some examples, a first end of the first power cable 216 is attached to the frame 202 of the projectile launcher 200. The first power cable 216 is routed around a limb pulley 256 on the second end 268 of the first limb 206 and fed into the string hub 210. In this example, a first end of the second power cable 218 is also attached to the frame 202 of the projectile launcher 200. The second power cable 218 is also routed around a limb pulley 258 on the second end 270 of the second limb 208 and fed into the string hub 210.

Figure 30:
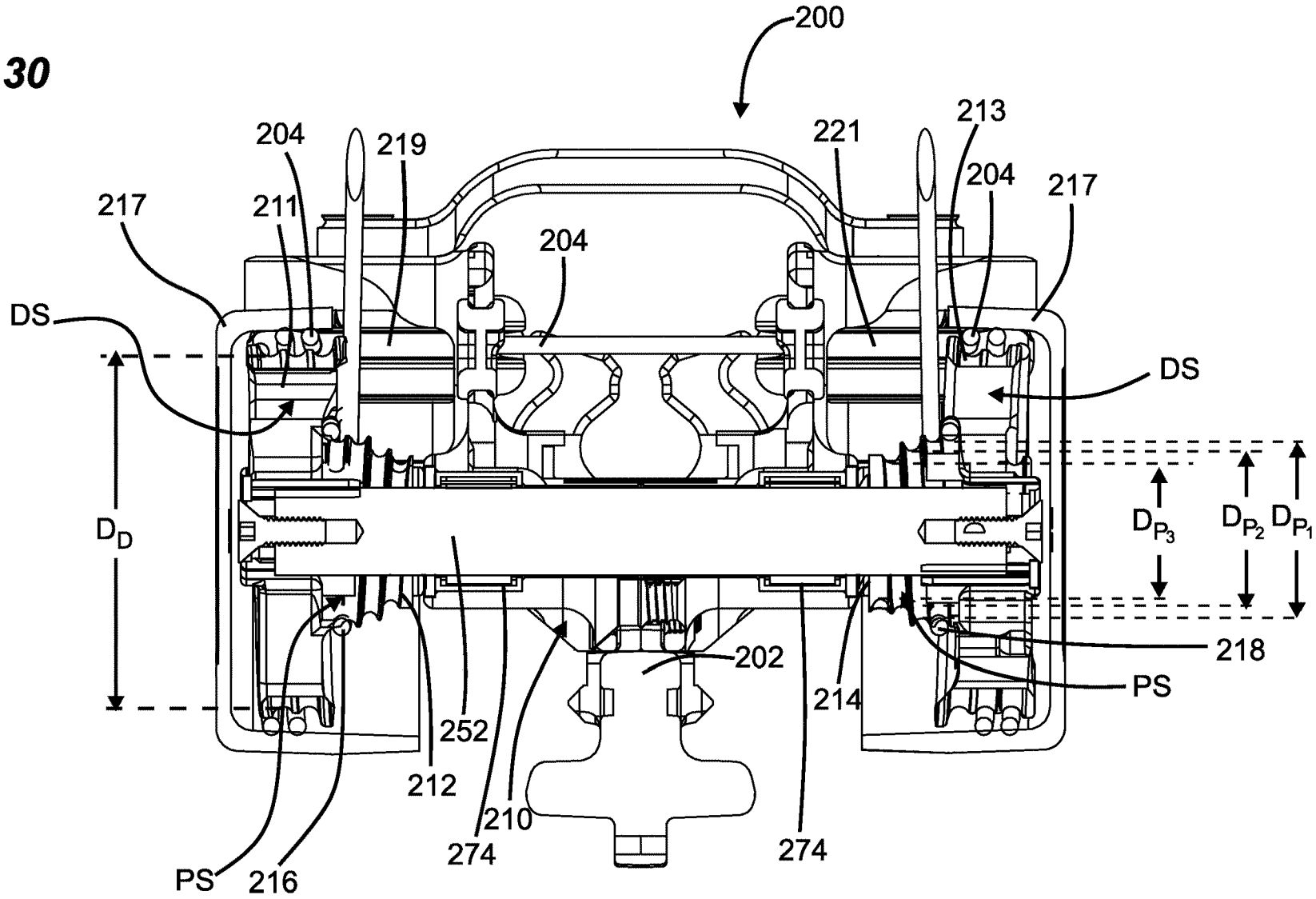
FIG. 30 shows a cross-sectional view along line 16-16 in FIG. 29 of the projectile launcher in the undrawn position.

FIG. 30 shows a cross-sectional view along line 16-16 in FIG. 29 of the string hub 210. In some examples, the string hub 210 includes bearings 274, and stationary drawstring wheel covers 217. The string hub 210 further includes the drawstring wheels 211, 213, the power wheels 212, 214, a shaft 252. In some examples, the drawstring wheels 211, 213, the power wheels 212, 214, and shaft 252 are connected in such a way that they rotate as a single unit. In some examples, the drawstring wheels 211, 213, the power wheels 212, 214, and shaft 252 are forged from a single piece of material, while in other examples, the drawstring wheels 211, 213, the power wheels 212, 214, and shaft 252 are connected to each other using fasteners. In some examples, as depicted in FIG. 30, the drawstring wheels 211, 213 are positioned laterally distal from the longitudinal center C of the projectile launcher 200 with respect to the power wheels 212, 214, while the power wheels 212, 214 are positioned laterally medial to the longitudinal center C of the projectile launcher 200 with respect to the drawstring wheels 211, 213. In some examples, the shaft 252 extends across the longitudinal center of the projectile launcher 200 between the power wheels 212, 214, and supports the power wheels 212, 214 and drawstring wheels 211, 213 on each of the left and right sides of the projectile launcher 200. In this example, the shaft 252 is held in a cantilever-like manner, as it is supported along its length by the bearings, while its ends, which are attached to and support the power wheels 212, 214 and drawstring wheels 211, 213 are unsupported.

In some examples, the large forces, high speeds, and cantilever positioning of the shaft 252 may lead to deterioration in the integrity of the shaft 252 structure. In particular, in some embodiments, the shaft 252 is susceptible to shearing along its length after repeated use. In such cases, it is desirable to manufacture the shaft 252 so that it has a sufficiently large cross-sectional diameter as to withstand such forces. In some examples, the diameter of the shaft 252 is greater than about 0.25 inches (or greater than 0.25 inches) (0.635 cm). In other examples, the diameter of the shaft 252 is greater than ⅜ inches (or greater than ⅜ inches) (0.952 cm). In other examples, the diameter of the shaft 252 is about 0.5 inches (such as, for example, 0.5 inches) (1.27 cm). In some embodiments, it is desirable to manufacture the shaft 252 from a resilient material capable of withstanding large shearing forces. In some examples, the shaft 252 is made from a durable metal material. In some examples, the metal is S7 tool steel heat treated to 48-50 HRC Similarly, due to the high forces experienced within the string hub 210, in some embodiments, the bearings 274 may be susceptible to wear and deterioration. In some embodiments, needle bearings are used in place of traditional ball bearings to better withstand the forces in the string hub 210, however, various types of bearings 274 may be employed. In some embodiments, multiple bearings 274 are used to support the shaft 252. In some embodiments, two bearings 274 are used so that one bearing 274 supports the shaft 252 along its length on each side of the shaft 252.

In some embodiments, the string hub 210 also includes the stationary drawstring wheel covers 217. In some embodiments, the drawstring wheel covers 217 are mounted to the frame 202 on each side of the projectile launcher 200 and enclose the drawstring wheels 211, 213. In some embodiments, the drawstring wheel covers 217 serve several functions. For example, the drawstring wheel covers 217 may prevent objects from entering the rotational path and interfering with the rotation of the drawstring wheels 211, 213 during the arming and firing of the projectile launcher 200. In some examples, the drawstring wheel covers 217 also help to hold the drawstring 204 in position. As explained in greater detail with reference to FIGS. 17 and 18, the drawstring 204 wraps around and fits within grooves of the drawstring wheels 211, 213. When fired, the drawstring wheels 211, 213 spin at high speeds. If uncontrolled, the drawstring 204 may become dislodged from the grooves of the drawstring wheels 211, 213. The inner surface of the inner diameter of the covers 217 helps to provide a backstop for the drawstring 204 so that it does not become dislodged from the grooves of the drawstring wheels 211, 213. In some examples, the inner diameter of the covers 217 is only slightly larger than the outer diameter of the drawstring wheels 211, 213. In these examples, only a minimal space exists between the surface of the drawstring 204 routed around the drawstring wheels 211, 213 and the surface of the inner diameter of the covers 217. In some examples, the inner surface of the inner diameter of the covers 217 lightly contacts the surface of the drawstring 204. In other examples, the space between the surface of the inner diameter of the drawstring wheels 211, 213 and the outer surface of the drawstring 204 is in a range from about 0 inches to about 0.125 inches (or 0 inches to 0.125 inches) (0 cm to 0.318 cm). In some examples, the space between the surface of the inner diameter of the drawstring wheels 211, 213 and the outer surface of the drawstring 204 is about 0.125 inches (or is 0.125 inches) (0 cm to 0.318 cm). The covers 217 can be made from a variety of materials. In some examples, the covers 217 are made of a rubber, plastic, or aluminum material. Although not shown in FIG. 30, in some examples, the covers 217 may also extend around and encircle the power wheels 212, 214 to provide similar functionality as noted above with reference to the drawstring wheels 211, 213.

An example embodiment of the projectile launcher includes a frame having a vertical grip, the frame defining a horizontal projectile plane at a top side in which a projectile axis is positioned, wherein a projectile moves within the horizontal projectile plane and along the projectile axis during firing and arming of the projectile launcher, wherein the projectile is fired from a front end of the frame, and wherein the projectile launcher further includes a string hub that drives the movement of a drawstring.

Another example includes, alone or in combination with the above example, a string hub rotatably mounted to the frame, the string hub being rotatable about a central axis in a first direction and a second direction, the central axis being perpendicular to the projectile axis.

Another example includes, alone or in combination with one or more of the above examples, a drawstring being attached to the drawstring hub, the drawstring traveling at least partially perpendicular to the projectile axis between first and the second ends of the drawstring, the drawstring being movable within the projectile plane during firing and arming of the projectile launcher, wherein movement of the drawstring away from the drawstring hub corresponds with rotation of the drawstring hub in the first direction, and wherein movement of the drawstring toward the drawstring hub corresponds with rotation of the drawstring hub in the second direction.

Another example includes, alone or in combination with one or more of the above examples, the projectile launcher, wherein the string hub includes a shaft, and wherein the diameter of the shaft is greater than 0.25 inches (0.635 cm).

Another example includes, alone or in combination with one or more of the above examples, the shaft, wherein the diameter of the shaft is greater than ⅜ inches (0.952 cm).

Another example includes, alone or in combination with one or more of the above examples, the shaft, wherein the diameter of the shaft is greater than 0.5 inches (1.27 cm).

Another example includes, alone or in combination with one or more of the above examples, the shaft, wherein the shaft is made from S7 tool steel heat treated to 48-50 HRC.

Another example includes, alone or in combination with one or more of the above examples, the projectile launcher, wherein the string hub includes a plurality of bearings, wherein the bearings are needle bearings.

Another example includes, alone or in combination with one or more of the above examples, the projectile launcher, wherein the string hub includes a plurality of wheels upon which the drawstring is wound.

Another example includes, alone or in combination with one or more of the above examples, the projectile launcher, wherein the string hub includes one or more stationary covers that enclose the one or more of the wheels.

Another example includes, alone or in combination with one or more of the above examples, the projectile launcher, wherein the stationary covers include an inner diameter sized approximately equal to the one or more wheels.

Another example includes, alone or in combination with one or more of the above examples, the projectile launcher, wherein the stationary covers include an inner diameter that contacts the outer surface of the drawstring when the drawstring is wound onto the one or more wheels.

Another example includes, alone or in combination with one or more of the above examples, the projectile launcher, wherein the stationary covers include an inner diameter that is spaced in a range from about 0 inches to about 0.125 inches (or 0 inches to 0.125 inches) (0 cm to 0.318 cm) from the outer surface of the drawstring when the drawstring is wound onto the one or more wheels.

Another example includes, alone or in combination with one or more of the above examples, the projectile launcher, wherein the stationary covers include an inner diameter that is spaced about 0.125 inches (0.318 cm) from the outer surface of the drawstring when the drawstring is wound onto the one or more wheels.

Figure 31:
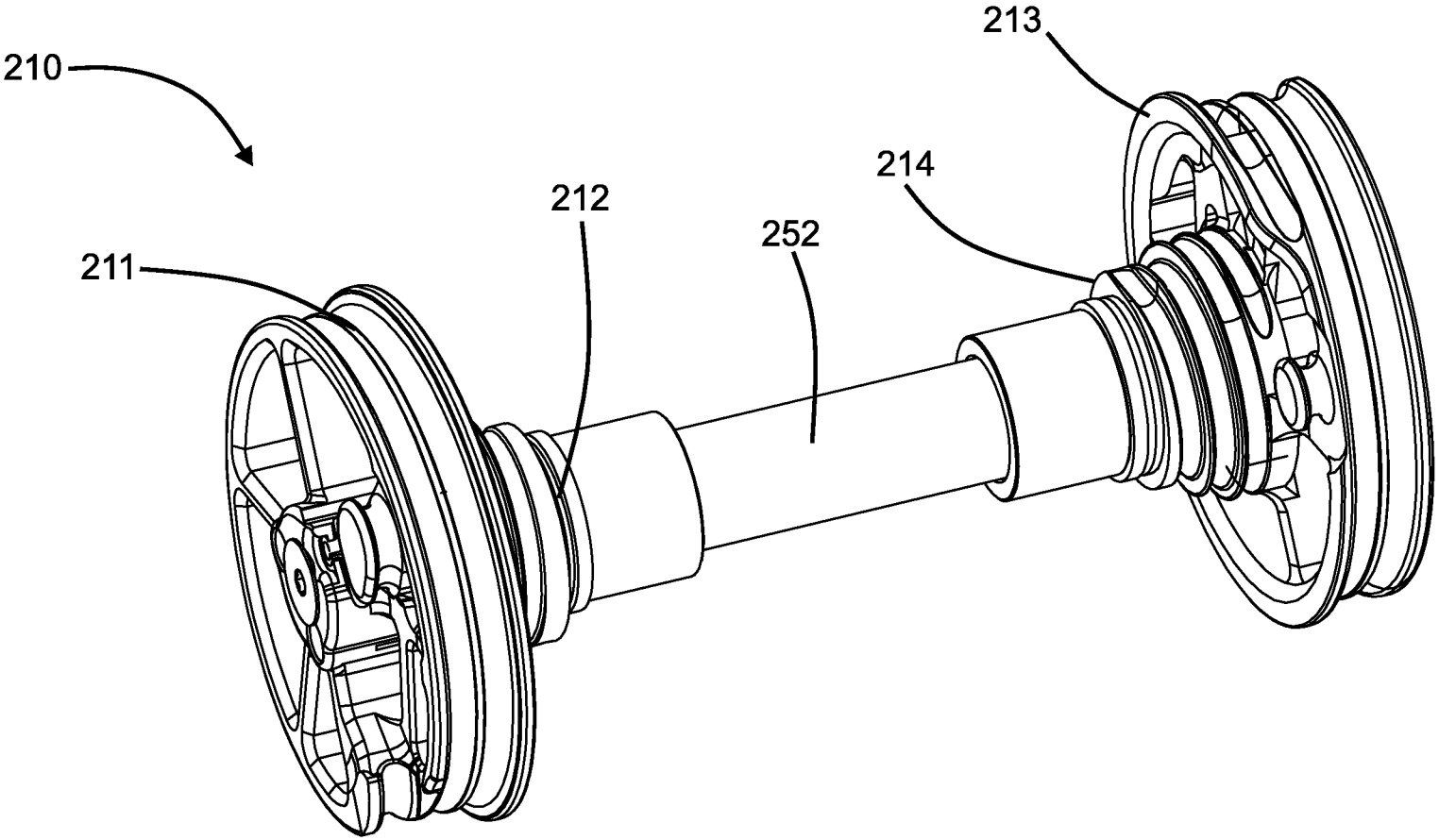
FIG. 31 shows a perspective view of an example string hub of a projectile launcher, according to one example of the present disclosure.
Figure 32:
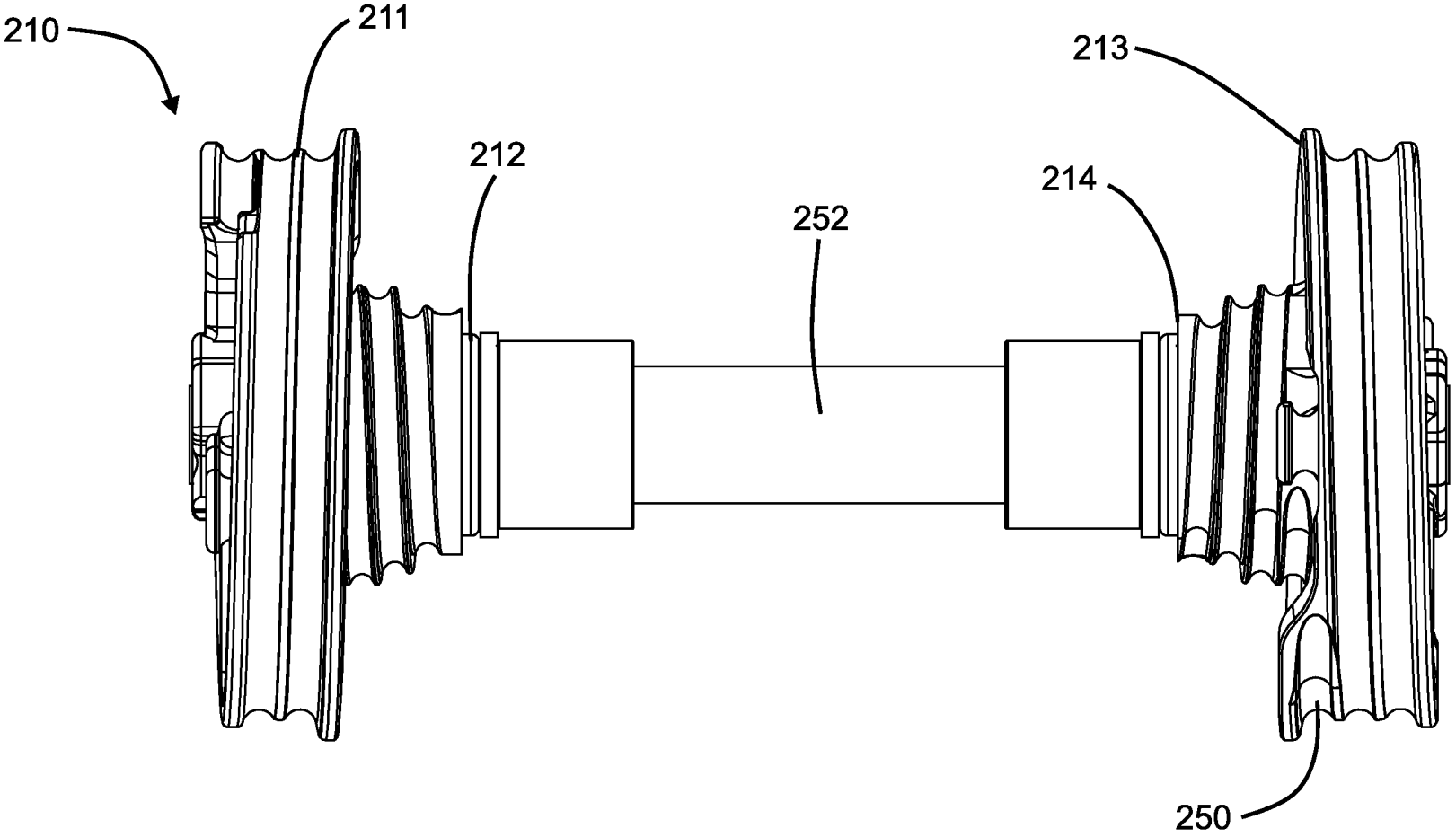
FIG. 32 shows a side view of the string hub of FIG. 31.

FIGS. 31 and 32 show the drawstring wheels 211, 213, power wheels 212, 214, and shaft of the string hub 210 removed from the projectile launcher 200. The string hub 210 of FIGS. 31-33 functions equivalently to the string hub 110, described in detail above with reference to FIGS. 17 and 18 above.

Figure 33:
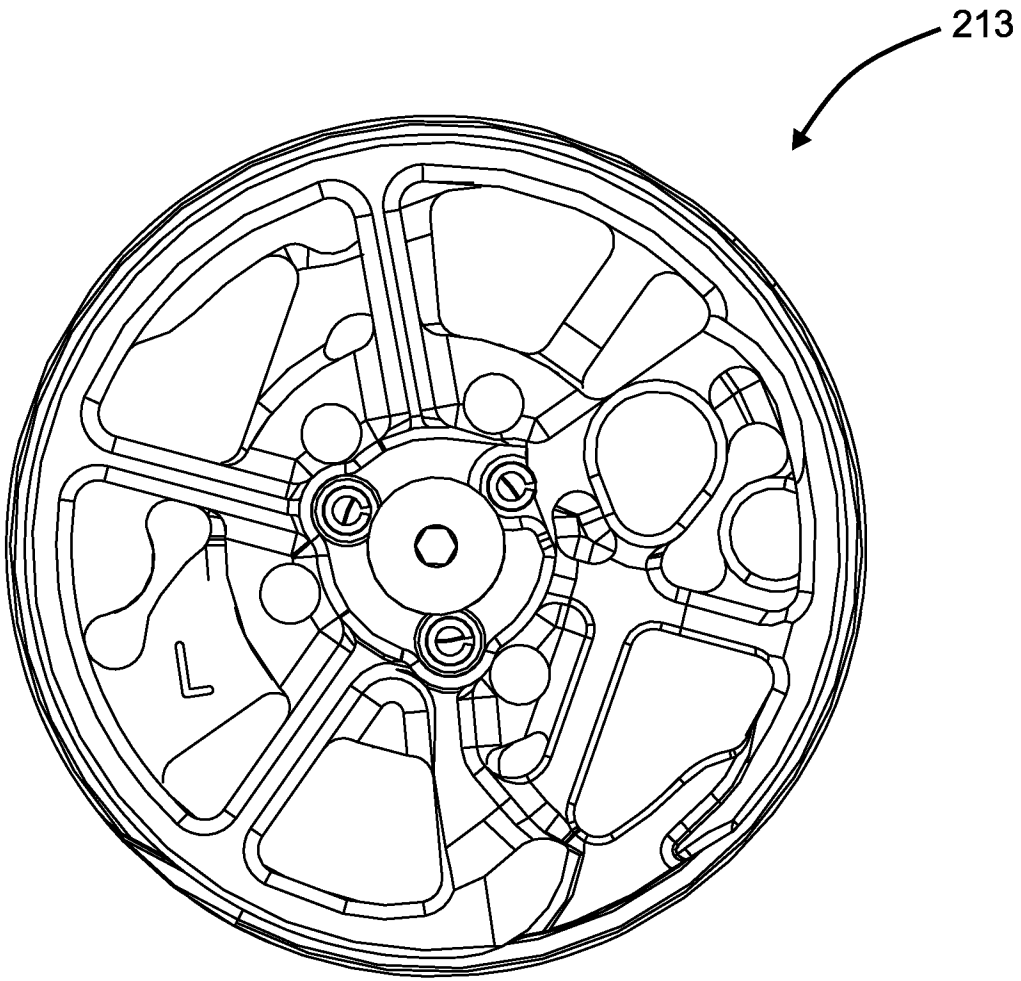
FIG. 33 shows a side view of a drawstring wheel of the string hub of FIG. 31.

FIG. 33 shows a side view of an example drawstring wheel 211 of the string hub 210. As seen in FIG. 33, the drawstring wheel 211 includes a variety of cutouts around the body of the drawstring wheel 211. In some examples, the cutouts decrease the mass of the drawstring wheel 211 while preserving the strength of the drawstring wheel 211 so that it does not break during repeated operation. Relatedly, the cutouts help to decrease the moment of inertia of the drawstring wheel 211. In some examples, decreasing the moment of inertia of the drawstring wheels 211, 213 decreases the wear on other firing components within the projectile launcher 200, as back and forth oscillations of the drawstring 204 after firing are minimized. Thus, it is desirable for the drawstring wheels 211, 213 to have low moments of inertia so that the movement of the drawstring wheels 211, 213 is quickly halted after firing a projectile. In some examples, the rotational moment of inertia of the drawstring wheels 211, 213 can be reduced to levels within a range from about 0.025 to about 0.1 (or from 0.025 to 0.1) pound square inches (0.0000731 kg square meters to 0.0000292 kg square meters). In other examples, the rotational moment of inertia of the drawstring wheels 211, 213 are about 0.045 (or are 0.045) pound square inches (0.000132 kg square meters).

Figure 34:
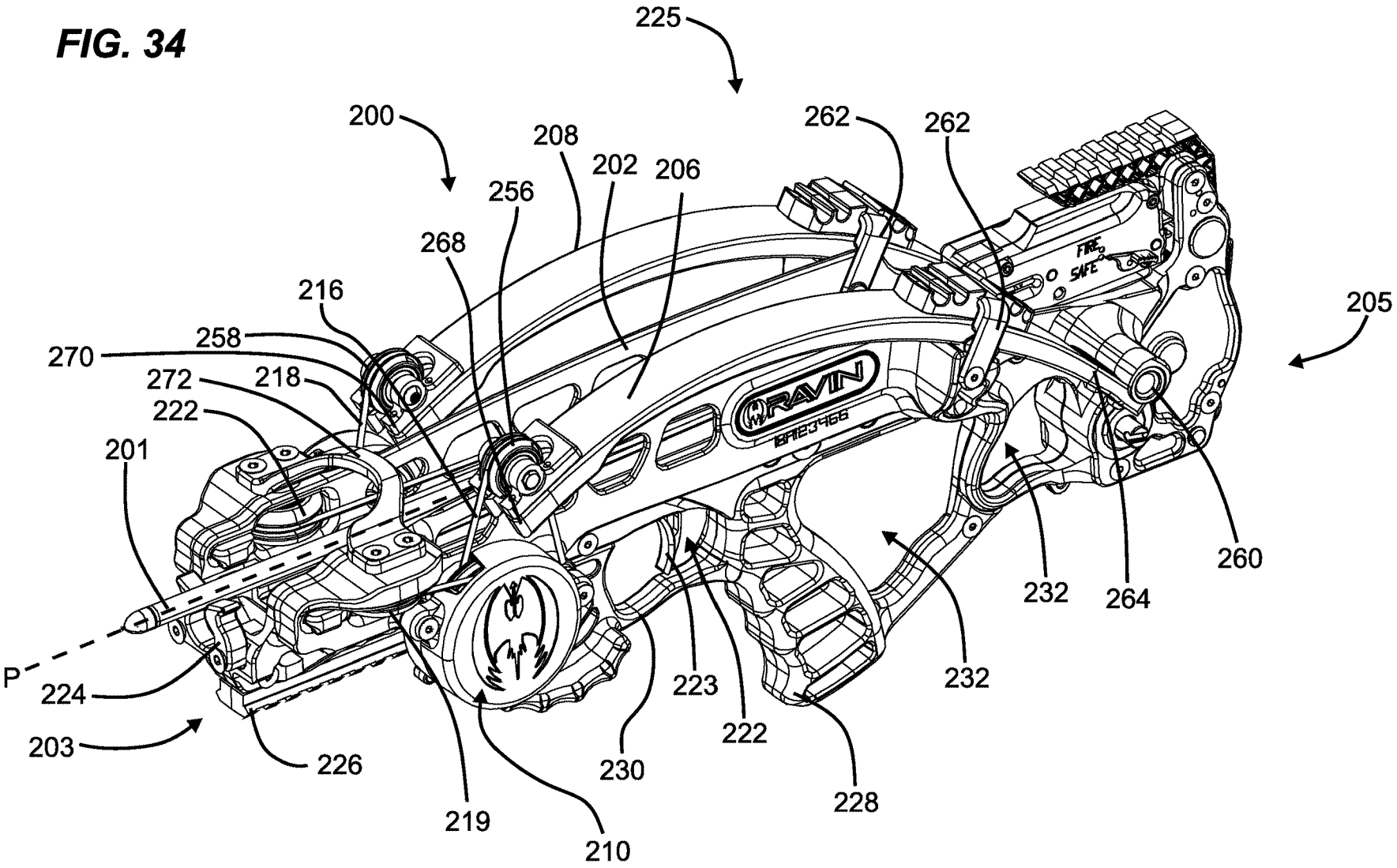
FIG. 34 shows a perspective of the projectile launcher of FIG. 26 in the drawn position.
Figure 35:
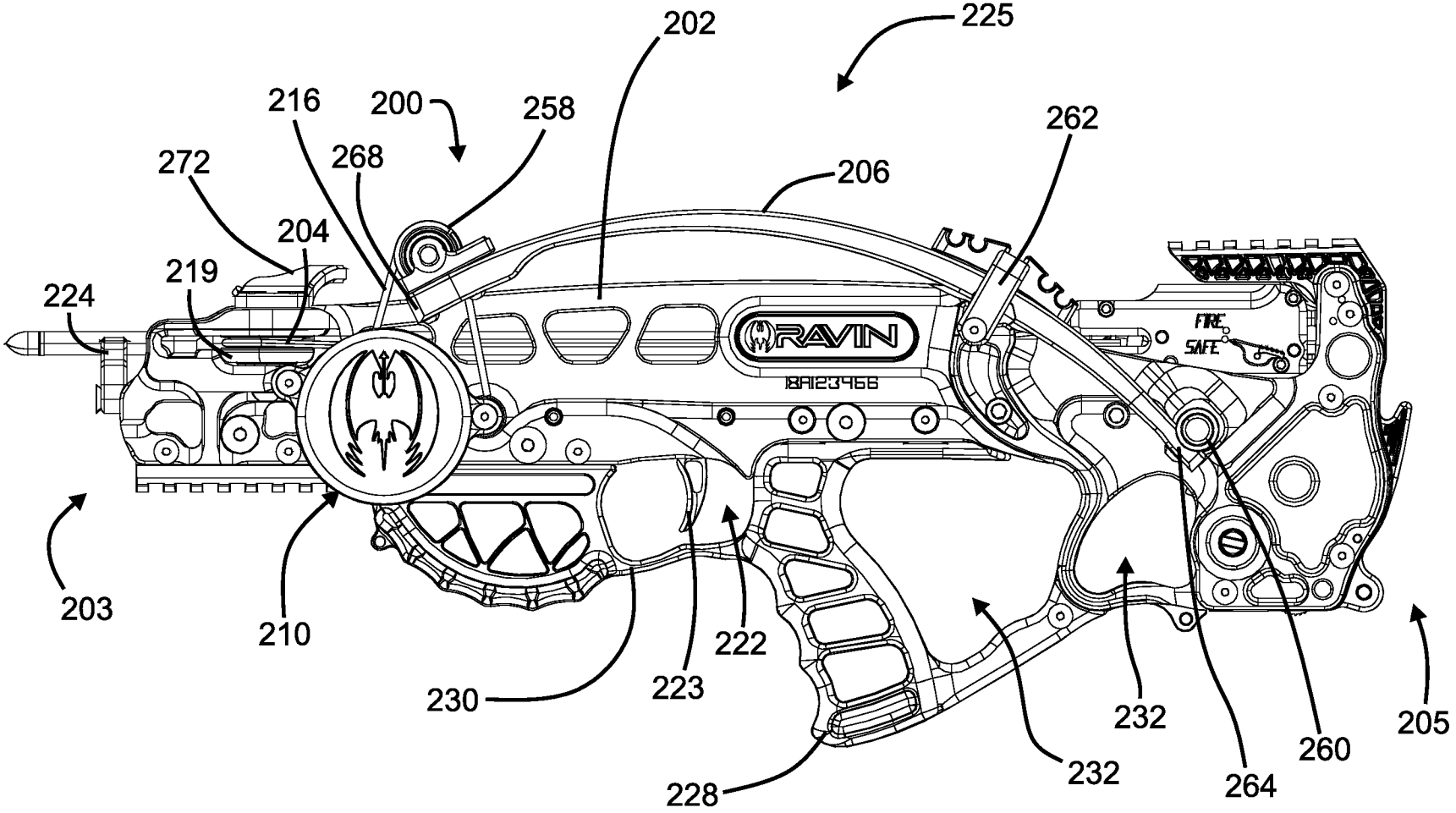
FIG. 35 shows a left side view of the projectile launcher of FIG. 26 in the drawn position.
Figure 36:
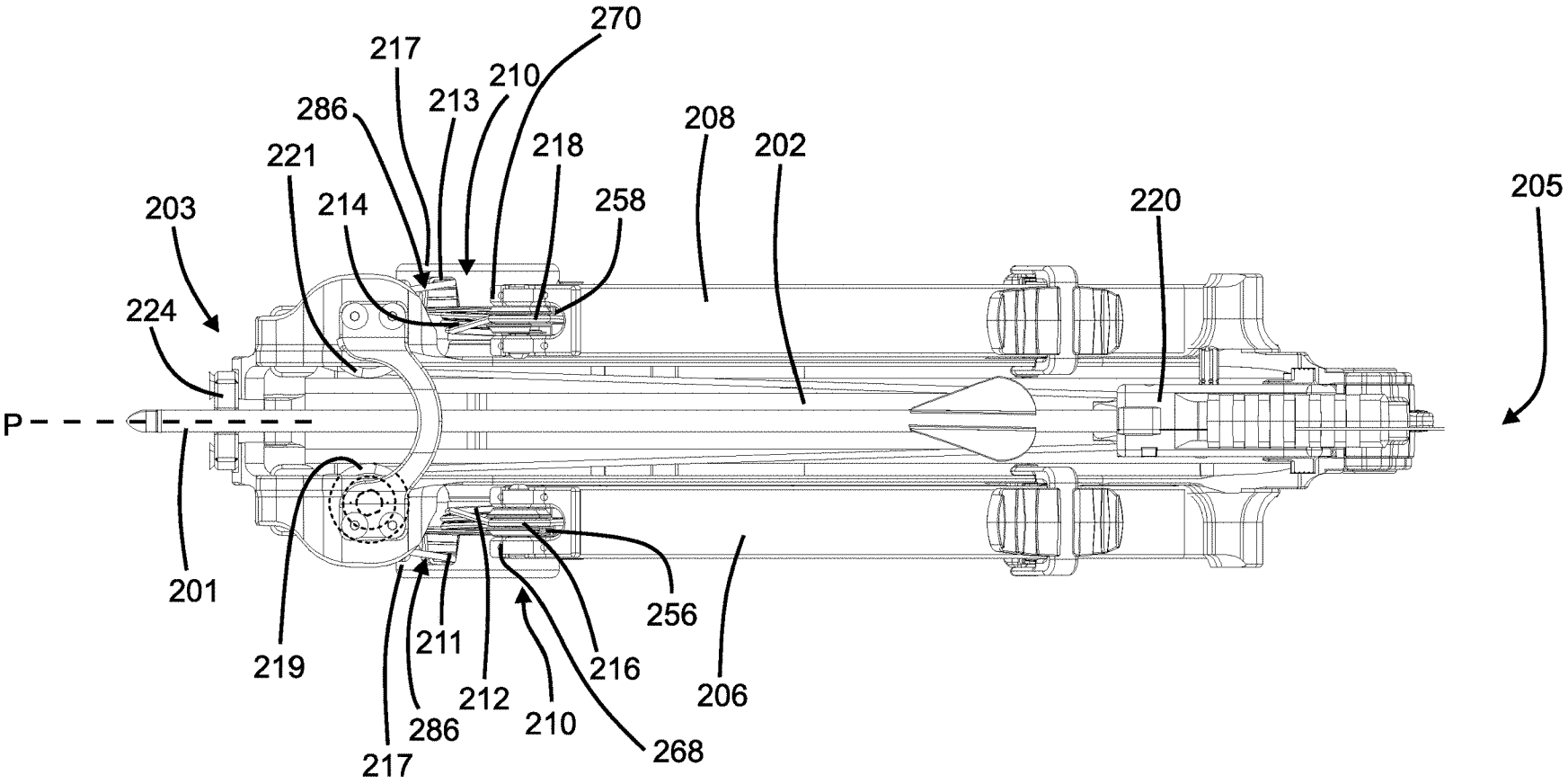
FIG. 36 shows a top view of the projectile launcher of FIG. 26 in the drawn position.

FIG. 34 shows a perspective view of the projectile launcher 200 in the drawn configuration, FIG. 35 shows a top view of the projectile launcher 200 in a drawn configuration, and FIG. 36 shows a side view of the projectile launcher 200 in a drawn configuration. With reference to FIGS. 34-36, as well as FIGS. 26-29, depicting the projectile launcher 200 in an undrawn configuration, the functionality of the limbs 206, 208, string hub 210, and drawstring 204 is explained.

The projectile launcher 200 operates by utilizing the movable latch 220 that travels along and between a front 203 and a rear 205 of the frame 202. The latch 220 travels to the front 203 of the projectile launcher 200 along the frame 202, attaches to the drawstring 204 and a user draws the latch 220 rearward along the projectile axis P. The remaining length of the drawstring 204 is routed around the drawstring guides 219, 221, into the string hub 210, around the drawstring wheels 211, 213 and attached to a point on each drawstring wheel at each end of the drawstring 204. As the drawstring 204 is brought rearward, the portions of the drawstring 204 wrapped around the drawstring wheels 211, 213 are gradually unspooled from the drawstring wheels 211, 213. Meanwhile, the power cables 216, 218 and drawstring 204 are each connected to the string hub 210 so that as the drawstring 204 is drawn rearward, the power cables 216, 218 are gradually drawn into the string hub 210 and around the power wheels 212, 214. The power cables 216, 218 are also connected to the limbs 206, 208, so that as the power cables 216, 218 are drawn into the string hub 210, the limbs 206, 208 are drawn downward and loaded Thus, as the knocking portion of the drawstring 204 is brought rearward, the drawstring guides 219, 221 and drawstring wheels 211, 213 spin in a first direction, and unwind a portion of the drawstring 204 from the drawstring wheels 211, 213. Meanwhile, the power cables 216, 218 are each attached to their respective power wheels 212, 214 at a first end and wrap around the respective power wheels 212, 214.

The remaining length of the power cables 216, 218 extends out from the string hub 210 and is connected to the limbs 206, 208. The rotation of the drawstring wheels 211, 213 in the first direction drives the rotation of the string hub 210 and the power wheels 212, 214 in the first direction. As the power wheels 212, 214 are rotated in the first direction, a portion of the remaining lengths of the power cables 216, 218 is wound around the power wheels 212, 214. As the power cables 216, 218 are wound around the power wheels 212, 214, the second ends of the limbs 206, 208 are drawn closer to the string hub 210 (compare FIGS. 26 and 34).

Once fully rearward, the latch 220 is secured and a projectile 201 (i.e., an arrow) can be loaded. The latch 220 is in communication with the trigger assembly 222 and the user can move a trigger pull 223 of the trigger assembly 222 to release the drawstring 204 from the latch 220, thereby propelling the projectile 201 forward from the projectile launcher 200.

Once the drawstring 204 is released, it is powered forward along the projectile axis P by the upward movement of the limbs 206, 208 and the rotation of the string hub 210 in a second direction. When the knocking length is released, the flexible limbs 206, 208 spring upward. This movement of the flexible limbs 206, 208 results in the rapid unwinding of the power cables 216, 218 from the power wheels 212, 214. The unwinding drives the rotation of the power wheels 212, 214 in the second direction, which drives the rotation of the string hub 210 and the drawstring wheels 211, 213 in the second direction. The rotation of the drawstring wheels 211, 213 in the second direction results in the rapid spooling of the drawstring 204 onto the drawstring wheels 211, 213 and the propulsion of the knocking length of the drawstring 204 forward towards the front end 203 of the projectile launcher 200 along the projectile axis.

Figure 5:
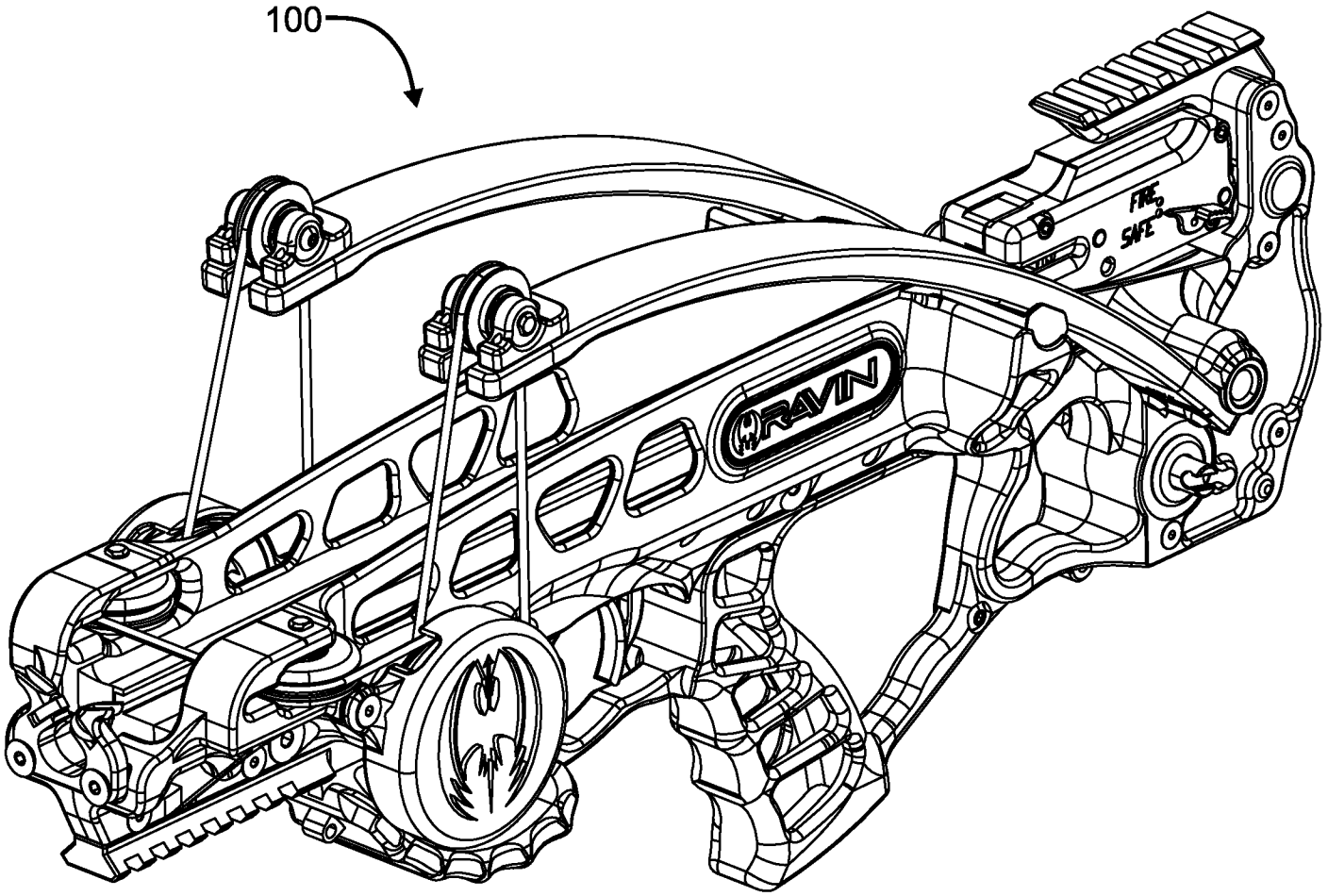
FIG. 5 shows a perspective view of a projectile launcher in the undrawn position, according to one example of the present disclosure.
Figure 6:
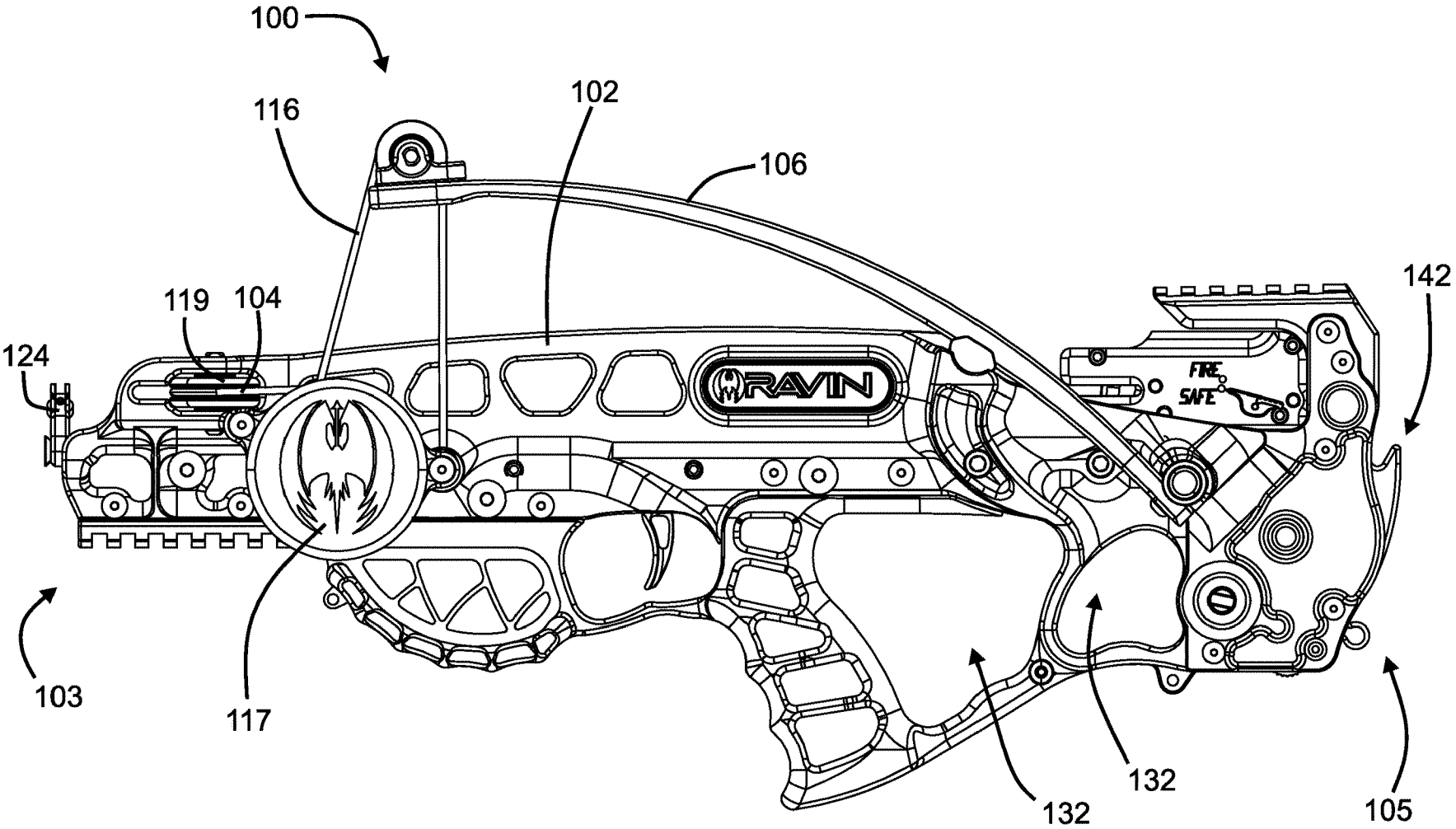
FIG. 6 shows a side view of the projectile launcher of FIG. 5 in the undrawn position.
Figure 7:
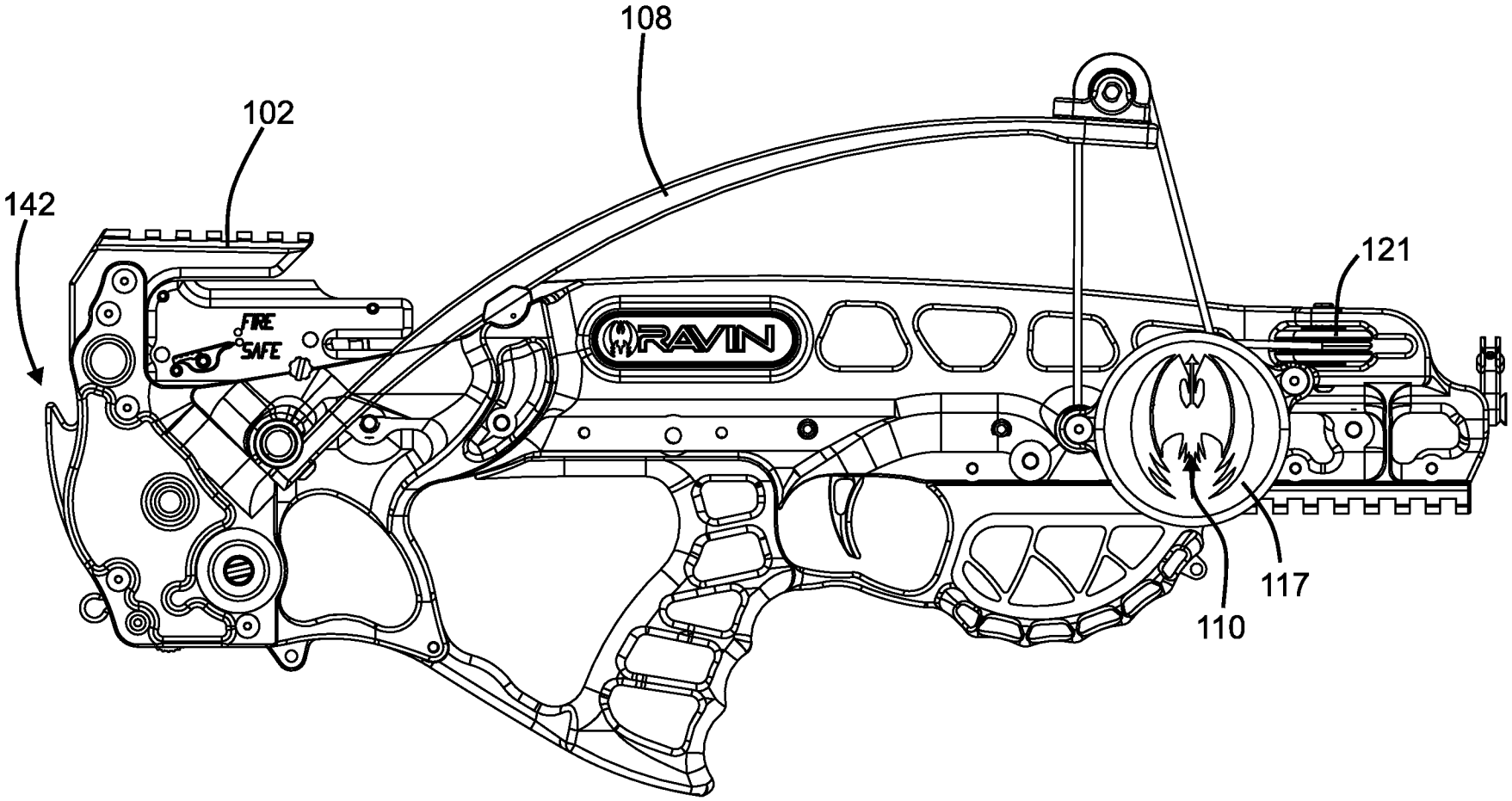
FIG. 7 shows another side view of the projectile launcher of FIG. 5 in the undrawn position.
Figure 8:
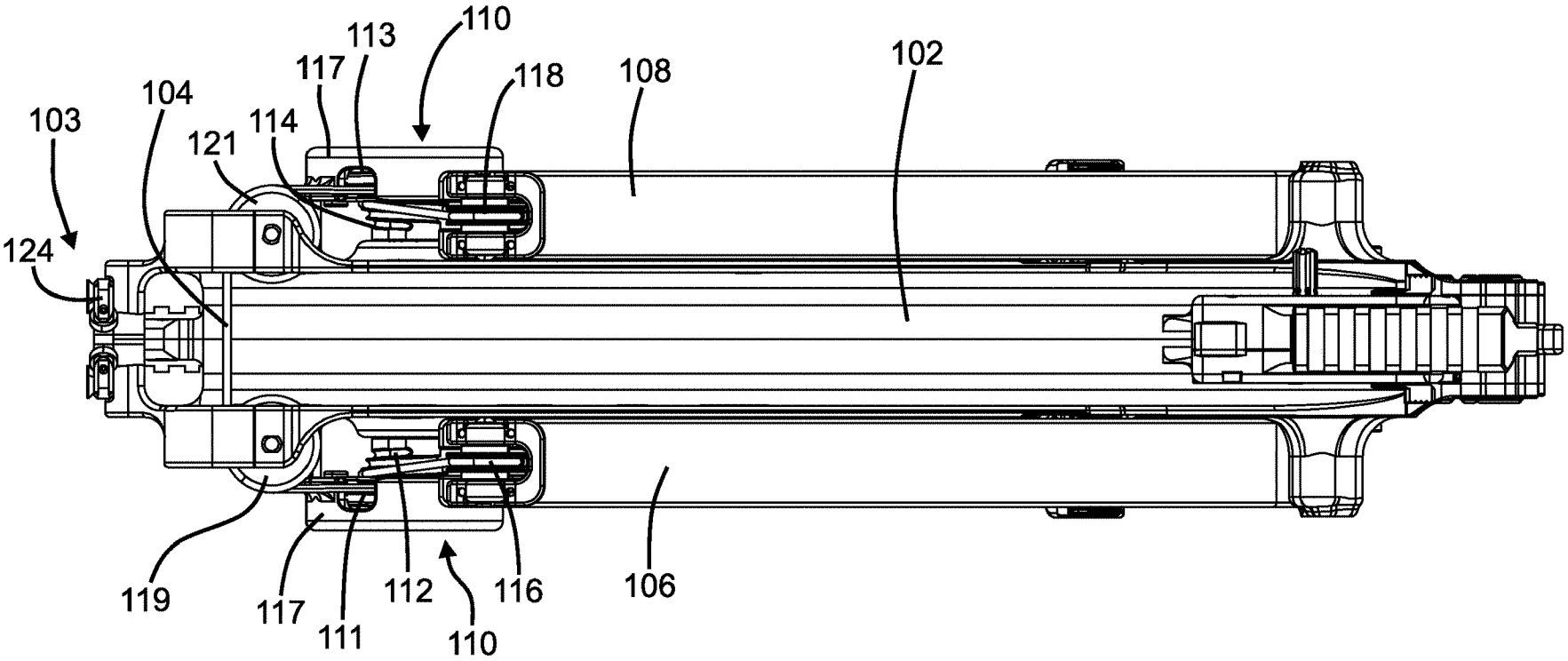
FIG. 8 shows a top view of the projectile launcher of FIG. 5 in the undrawn position.
Figure 37:
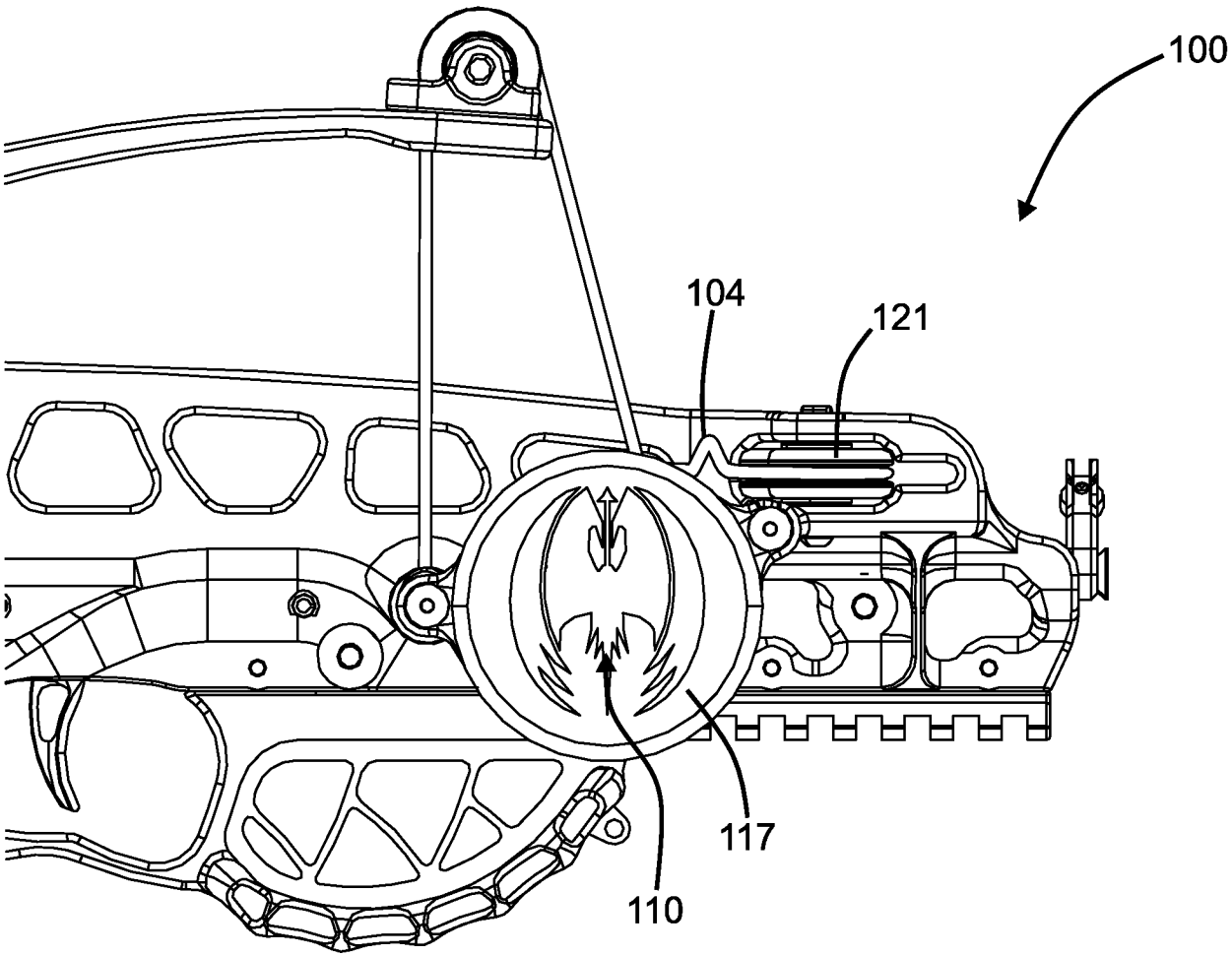
FIG. 37 shows a side view of the projectile launcher of FIG. 5 in a misfiring scenario.

FIG. 37 is a side view of the projectile launcher 100 of FIG. 5, depicting a misfiring scenario. In some examples, as depicted by FIG. 37, as the projectile launcher 100 is fired and the drawstring 104 is rapidly wound onto the drawstring wheels 111, 113, the drawstring 104 may follow an erratic spooling path and may become dislodged from the grooves of the drawstring guides 119, 121, which results in the misoperation of the projectile launcher 100.

Moving back to FIG. 36, in some examples, to ensure the proper spooling of the drawstring 204 onto the drawstring wheel and prevent dislodging of the drawstring 204, the covers include cutouts 286 that define openings for the drawstring 204 to travel into the string hub 210. The cutouts 286 may be various shapes and sizes as needed to properly route the drawstring 204 onto the drawstring wheels 211, 213.

Figure 38:
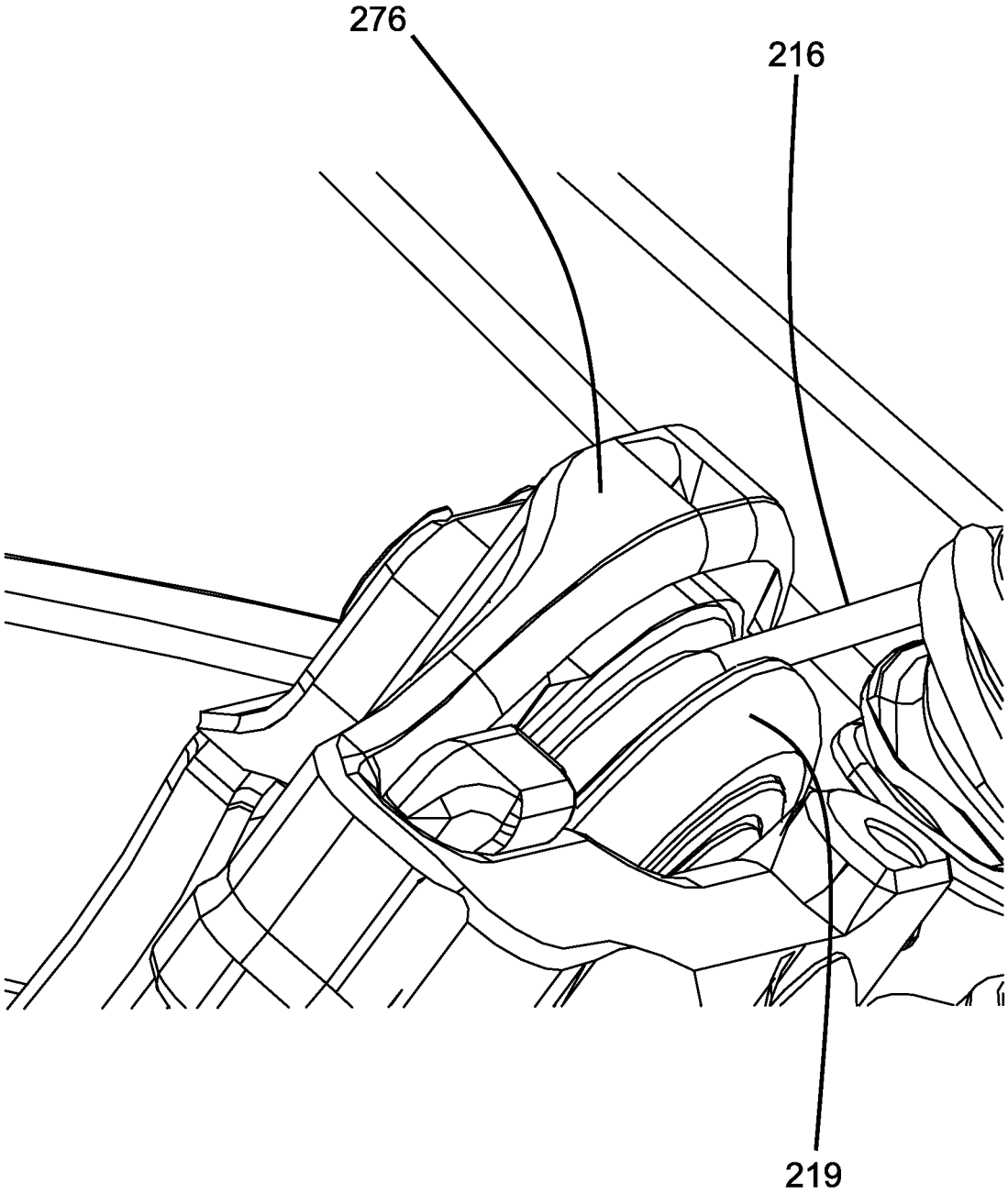
FIG. 38 shows a perspective view of the drawstring guides and hood of the projectile launcher of FIG. 26.

In some examples, the frame 202 above the drawstring guides 219, 221 also provide similar advantages to minimize misfiring. FIG. 38 is a perspective view, depicting the frame 202 and the drawstring guide 219. In this example, the portion of the frame 202 directly above the drawstring guides 219, 221 is built out to provide a drawstring guide hood 276. The drawstring guide hood 276 is configured to extend laterally out from the frame 202 and over the edge of the drawstring guides 219, 221. The hood 276 extends around and down over the edge of the drawstring guides 219, 221 so that a bottom surface of the hood is flush with an upper edge of the groove of the drawstring guides 219, 221. A recess in the hood 276 in which the drawstring guide 219, 221 is positioned is formed have an inner diameter only slightly larger than the outer diameter of the drawstring guides 219, 221 so that very little space exists between the outer diameter of the drawstring guide 219, 221 and the inner diameter of the recess of the hood 276. By having a bottom edge that is flush with the upper edge of the groove of the drawstring guides 219, 221, the hood 276 functions to prevent the drawstring 204 from moving out of the groove of the drawstring guides 219, 221 in the upward direction as the drawstring 204 is wound onto the drawstring wheel during the firing of the projectile launcher 200. In some embodiments, the hood 276 is positioned on the bottom side of the drawstring guides 219, 221, with or without the use of the hood 276 on the top side of the drawstring guides 219, 221, to prevent the drawstring 204 from becoming dislodged by falling off a bottom edge of the drawstring guides 219, 221.

Additional Example Embodiments

An example embodiment of the projectile launcher includes a frame having a vertical grip, the frame defining a horizontal projectile plane at a top side in which a projectile axis is positioned, wherein a projectile moves within the horizontal projectile plane and along the projectile axis during firing and arming of the projectile launcher, wherein the projectile is fired from a front end of the frame.

Another example includes, alone or in combination with the above example, a string hub rotatably mounted to the frame, the string hub being rotatable about a central axis in a first direction and a second direction, the central axis being perpendicular to the projectile axis.

Another example includes, alone or in combination with one or more of the above examples, a drawstring being attached to the drawstring hub, the drawstring traveling at least partially perpendicular to the projectile axis between first and the second ends of the drawstring, the drawstring being movable within the projectile plane during firing and arming of the projectile launcher, wherein movement of the drawstring away from the drawstring hub corresponds with rotation of the drawstring hub in the first direction, and wherein movement of the drawstring toward the drawstring hub corresponds with rotation of the drawstring hub in the second direction.

Another example includes, alone or in combination with one or more of the above examples, a first and a second flexible limb attached to the frame, wherein the first and second limbs a in an unloaded position when the projectile launcher is undrawn and in a loaded position when the projectile launcher is drawn.

Another example includes, alone or in combination with one or more of the above examples, a first and a second power cable each having a first end and a second end, wherein the first ends of the first and second power cables are attached to the string hub at power cable sections, wherein upon rotation of the string hub in the first direction, the first and second power cables are configured to draw the first and second flexible limbs closer to the string hub.

Another example includes, alone or in combination with one or more of the above examples, a latch movable between the rear end of the frame and the front end of the frame and attached to a crank mechanism via a tether, the latch being configured to receive the drawstring and hold the drawstring at the rear end of the frame when the crossbow is drawn, the latch being configured to receive a portion of the projectile and the drawstring therein, wherein the tether travels downward from the latch to wrap around a first gear of the crank mechanism, the crank mechanism having a spring loaded stop in communication with the first gear, the stop being biased against the first gear, and wherein the stop is accessible at an underside of the frame.

Another example includes, alone or in combination with one or more of the above examples, a trigger assembly being in communication with the latch, wherein upon activation of the trigger assembly when firing, the trigger assembly moves the latch and the drawstring is released from the latch.

Another example includes, alone or in combination with one or more of the above examples, first and second drawstring guides attached to the frame, each guide guiding the drawstring across the projectile axis between the first and second ends of the drawstring.

Another example includes, alone or in combination with one or more of the above examples, a crossbow or projectile launcher that includes a movable, compact windable latch mechanism.

Another example includes, alone or in combination with one or more of the above examples, a crossbow or projectile launcher wherein the latch mechanism includes a latch, a tether, and a crank mechanism, wherein the latch is configured to move parallel to a projectile axis and wherein the crank mechanism is configured to pull at least a portion of the tether at least partially in a direction perpendicular to the projectile axis.

Another example includes, alone or in combination with one or more of the above examples, a crossbow or projectile launcher wherein the latch mechanism further comprises a guide, and wherein a first portion of the tether extends between the guide and the latch in a direction parallel to the projectile axis, and wherein a second portion of the tether extends between the guide and the crank mechanism at least partially in the direction perpendicular to the projectile axis.

Another example includes, alone or in combination with one or more of the above examples, a crossbow or projectile launcher that includes a drawstring, a pair of power strings, a string hub, and an interface for a modular stock.

Another example includes, alone or in combination with one or more of the above examples, a crossbow or projectile launcher that includes a string hub that has an increasing size of grooves on the power cable section.

Another example includes, alone or in combination with one or more of the above examples, a crossbow or projectile launcher that includes a latch mechanism positioned below a latch.

Another example includes, alone or in combination with one or more of the above examples, a crossbow or projectile launcher that includes a frame having a stock interface at a rear end, the stock interface configured to removably secure a stock.

Another example includes, alone or in combination with one or more of the above examples, a crossbow or projectile launcher comprising a frame having a multi-piece construction.

Another example includes, alone or in combination with one or more of the above examples, a crossbow or projectile launcher comprising a drawstring wheel having a spiral groove, and a drawstring, wherein the drawstring wheel is configured to receive a portion of the drawstring in the spiral groove, wherein the spiral groove passes at least three times around the drawstring wheel.

The various embodiments described herein are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A projectile launcher comprising:

a trigger for firing the projectile launcher;

a frame having a vertical grip, the frame defining a horizontal projectile plane at a top side in which a projectile axis is positioned, wherein a projectile moves within the horizontal projectile plane and along the projectile axis during firing and arming of the projectile launcher, wherein the projectile is fired from a front end of the frame; and a limb arranged to flex in a vertical plane with a limb support arranged at a first end of the limb, the limb support being positioned rearward of the trigger.

2. The projectile launcher claim 1, further comprising a medial limb support along a length of the limb.

3. The projectile launcher according to any one of the above claims of claim 2, wherein the medial limb support is positioned in front of the trigger.

4. The projectile launcher of claim 2, wherein the medial limb support is positioned rearward of the trigger.

5. The projectile launcher of claim 1, wherein the projectile launcher comprises a second limb arranged to flex in a vertical plane with a limb support at the first end of the limb, and wherein the limb support is positioned rearward of the trigger.

6. The projectile launcher of claim 1, further comprising a pulley mounted to the second end of the limb.

7. The projectile launcher of claim 1, wherein the vertical grip is positioned in between the limb support and the trigger.

8. The projectile launcher of claim 1, wherein the frame has a length between a front end and a rear end of the frame in a range from 15 inches to 23 inches.

9. The projectile launcher according to claim 1, wherein the frame has a length of about 18.75 inches between the front and rear ends of the frame.

10. A projectile launcher comprising:

a frame having a vertical grip, the frame defining a horizontal projectile plane at a top side in which a projectile axis is positioned, wherein a projectile moves within the horizontal projectile plane and along the projectile axis during firing and arming of the projectile launcher, wherein the projectile is fired from a front end of the frame;

a string hub rotatably mounted to the frame, the string hub being rotatable about a central axis in a first direction and a second direction, the central axis being perpendicular to the projectile axis;

a drawstring being attached to the string hub, the drawstring traveling at least partially perpendicular to the projectile axis between first and second ends of the drawstring, the drawstring being movable within the projectile plane during firing and arming of the projectile launcher, wherein movement of the drawstring away from the string hub corresponds with rotation of the string hub in the first direction, and wherein movement of the drawstring toward the string hub corresponds with rotation of the string hub in the second direction;

a first and a second flexible limb attached to the frame, wherein the first and second limbs are arranged to flex in a vertical plane when the projectile launcher is drawn, and wherein each of the first and second limbs are supported rearward of the vertical grip by a limb support at a first end of the first and second limbs; and a first and a second power cable each having a first end and a second end, wherein the first ends of the first and second power cables are attached to the string hub, wherein upon rotation of the string hub in the first direction, the first and second power cables are configured to draw the first and second flexible limbs closer to the string hub.

11. The projectile launcher of claim 10, wherein each of the first and second limbs are supported by a medial limb support between their first end and second end.

12. The projectile launcher of claim 11, wherein the medial limb support is positioned in front of the vertical grip.

13. The projectile launcher of claim 11, wherein the medial limb support is positioned rearward of the vertical grip.

14. The projectile launcher of claim 10, further comprising a pulley positioned at the second end of each of the first and second flexible limbs.

15. The projectile launcher of claim 10, wherein the string hub is positioned in front of the vertical grip.

16. The projectile launcher of claim 10, further comprising a stock mounted to the rear of the frame, wherein the limb support is positioned in between the vertical grip and the stock.

17. The projectile launcher of claim 10, wherein the frame has a length between a front end and a rear end of the frame in a range from 15 inches to 23 inches.

18. The projectile launcher of claim 10, wherein the frame has a length of 18.75 inches between the front and rear ends of the frame.

19. The projectile launcher of claim 10, wherein the first and second limbs extend upwardly and over the vertical grip.

20. A projectile launcher comprising:

a frame having a grip positioned underneath and configured to fire a projectile from a front;

a trigger coupled to the frame and selectable to release the projectile;

a limb support connected to the frame rearward of the trigger; and a limb connected at an end to the limb support and configured to flex in a vertical plane.

* * * * *